US012622517B2

(12) United States Patent
Liu et al.

(10) Patent No.: US 12,622,517 B2
(45) Date of Patent: May 12, 2026

(54) SMART LOCKER

(71) Applicant: SHOPEE IP SINGAPORE PRIVATE LIMITED, Singapore (SG)

(72) Inventors: Chun-Lin Liu, Taipei (TW); Zheng-Lun Feng, Taipei (TW)

(73) Assignee: SHOPEE IP SINGAPORE PRIVATE LIMITED, Singapore (SG)

( * ) Notice: Subject to any disclaimer, the term of this patent is extended or adjusted under 35 U.S.C. 154(b) by 33 days.

(21) Appl. No.: 18/623,874

(22) Filed: Apr. 1, 2024

(65) Prior Publication Data

US 2024/0349888 A1 Oct. 24, 2024

(30) Foreign Application Priority Data

Apr. 24, 2023 (TW) ..... 112115221

(51) Int. Cl.
*A47G 29/14* (2006.01)
*A47B 57/58* (2006.01)
*A47G 29/30* (2006.01)

(52) U.S. Cl.
CPC ..... *A47B 57/585* (2013.01); *A47G 29/141* (2013.01); *A47G 29/30* (2013.01); *A47B 2220/0091* (2013.01)

(58) Field of Classification Search
CPC ..... A47B 57/585; A47B 88/60; A47B 88/417; A47B 96/063; A47B 96/066; A47G 29/141; A47G 29/30
See application file for complete search history.

(56) References Cited

U.S. PATENT DOCUMENTS

| | | | | |
|---|---|---|---|---|
| 5,762,213 | A | 6/1998 | Heneveld, Sr. | |
| 2019/0281979 | A1 | 9/2019 | Lee et al. | |
| 2019/0370744 | A1 | 12/2019 | Fee et al. | |
| 2021/0142277 | A1* | 5/2021 | Fee | G07C 9/00571 |
| 2021/0321810 | A1* | 10/2021 | Sun | G07F 11/1653 |
| 2022/0250840 | A1* | 8/2022 | Wilkinson | B65G 1/045 |

(Continued)

FOREIGN PATENT DOCUMENTS

| | | | |
|---|---|---|---|
| CN | 109008323 | A | 12/2018 |
| CN | 209058404 | U | 7/2019 |
| CN | 111374458 | A | 7/2020 |

(Continued)

OTHER PUBLICATIONS

Extended European Search Report mailed Sep. 16, 2024, 9 pages, for the corresponding European Patent Application No. 24170151.5.

*Primary Examiner* — Sisay Yacob
(74) *Attorney, Agent, or Firm* — Straylight LLP

(57) ABSTRACT

Provided is a smart locker, including a cabinet, a plurality of locker doors, and a plurality of shelf boards configured to vertically divide a storage space of the cabinet into one or more locker compartments. In some examples, each of the one or more locker compartments includes a locker door of the plurality of locker doors. Moreover, when a locker door of a first locker compartment of the one or more locker compartments that is adjacent to a second locker compartment of the one or more locker compartments is closed, a position of a shelf board of the plurality of shelf boards that forms the first locker compartment is limited by the locker door of the first locker compartment.

15 Claims, 28 Drawing Sheets

(56) References Cited

U.S. PATENT DOCUMENTS

2023/0394425 A1* 12/2023 Chaney ..... G06Q 20/18

FOREIGN PATENT DOCUMENTS

| | | | |
|---|---|---|---|
| CN | 112716175 | A | 4/2021 |
| CN | 115769284 | A | 3/2023 |
| EP | 4344587 | A1 | 4/2024 |
| TW | M566015 | U | 9/2018 |
| TW | 202021505 | A | 6/2020 |

* cited by examiner

Please insert the payable amount

Last 3 digits of mobile number: 618

Consignee's name: Xiaobian Xia

| Parcel | Payable Amount |
|---|---|
| SPXcell A001 | $618 |
| SPXcell A002 | $618 |
| SPXcell A003 | $618 |
| SPXcell A004 | $618 |
| SPXcell A005 | $618 |
| SPXcell A006 | $618 |
| SPXcell A007 | $618 |
| SPXcell A008 | $340 |
| SPXcell A009 | $340 |
| SPXcell A010 | $340 |

Total pickup quantity 7 Total payable amount $4,326

Amount to be paid $126

Amount inserted $4,200

When the Amount inserted reaches the Amount to be paid, the payment will be completed automatically Cancel Dear user, once you successfully enter the pickup verification code for pickup (Non-Cash on Delivery)/payment for pickup (Cash on Delivery), Shopee Express pickup system will open your smart locker. The pickup process will be considered complete once you or an authorized person have completed it. To ensure your rights, please confirm your pickup compartment number and take your completed parcel out of the store. Any parcels left behind will no longer be stored by Shopee Express.

FIG. 8B

Please insert the payable amount

Last 3 digits of mobile number 618

Consignee's name Xiaobian Xia

| Parcel | Payable Amount |
|---|---|
| SPXcellA001 | $618 |
| SPXcellA002 | $618 |
| SPXcellA003 | $618 |
| SPXcellA004 | $618 |
| SPXcellA005 | $618 |
| SPXcellA006 | $618 |
| SPXcellA007 | $618 |
| SPXcellA008 | $340 |
| SPXcellA009 | $340 |
| SPXcellA010 | $340 |

Total pickup quantity 7 Total payable amount $4,326

Amount to be paid $126

Amount inserted $4,200

When the Amount inserted reaches the Amount to be paid, the payment will be completed automatically Cancel Dear user, once you successfully enter the pickup verification code for pickup (Non-Cash on Delivery)/payment for pickup (Cash on Delivery), Shopee Express pickup system will open your smart locker. The pickup process will be considered complete once you or an authorized person have completed it. To ensure your rights, please confirm your pickup compartment number and take your completed parcel out of the store. Any parcels left behind will no longer be stored by Shopee Express.

FIG. 10C

SMART LOCKER

CROSS REFERENCE TO RELATED APPLICATIONS

This patent application claims the benefit and priority of Taiwanese Patent Application No. 112115221, filed with the Taiwan Intellectual Property Office on Apr. 24, 2023, entitled "SMART LOCKER," the content of which is incorporated by reference in its entirety.

TECHNICAL FIELD

The present invention relates to a storage device and, in particular, to a smart locker and a method for storing objects in the same.

BACKGROUND

Services such as online shopping and parcel storage and pickup have rapidly developed in recent years. Store pickup or supermarket pickup have become common ways of online shopping pickup, and various online shopping platforms and pickup and delivery service providers both are eager to improve the convenience and service efficiency of sending and pickup etc. Thus, various types of electronic storage cabinets are available on the market. Traditional electronic storage cabinets or lockers typically use fixed locker compartments for storing articles, meaning that the storage space in each locker compartment is fixed. However, due to differences in the nature and types of goods, the material and volume of the parcels required also varies, and there are many differences in the size of parcels to be picked up. The fixed locker compartments cannot fully utilize the storage efficiently with respect to parcels or goods having larger volume or special shape. In addition, if parcels to be shelved are all small parcels and locker compartments are fixed large locker compartments, there may be a waste of space. Therefore, the flexible use of locker compartments is also an important issue for electronic storage cabinets.

SUMMARY

Therefore, the present invention provides a smart locker and a method for storing an object in the same to solve the above problem.

In some embodiments, the present invention provides a smart locker, including: a cabinet; a plurality of locker doors; and a plurality of shelf boards configured to vertically divide a storage space of the cabinet into one or more locker compartments, each locker compartment corresponding to one or more locker doors of the plurality of locker doors. When a locker door corresponding to a locker compartment adjacent to a specific locker compartment of the one or more locker compartments is closed, a position of a corresponding shelf board that forms the adjacent locker compartment in the specific locker compartment is limited by the locker door corresponding to the adjacent locker compartment.

In some embodiments, a first inner surface of the cabinet and a second inner surface opposite to the first inner surface are correspondingly provided with a plurality of dividing components, and the plurality of shelf boards are placed on the plurality of dividing components to vertically divide the storage space of the cabinet into the one or more locker compartments. In addition, each dividing component is a sliding rail.

In some embodiments, each shelf board includes: a first limiting component and a second limiting component respectively disposed at two ends of a first side of an upper surface of the shelf board, wherein the first limiting component and the second limiting component have a first height relative to the upper surface of the shelf board. In addition, the first limiting component and the second limiting component are bulges or protrusions.

In some embodiments, each shelf board further includes: a third limiting component and a fourth limiting component disposed at two ends of a second side opposite to the first side of a lower surface of the shelf board, wherein the third limiting component and the fourth limiting component have a second height relative to the lower surface of the shelf board, wherein the first height is greater than the second height. When the shelf board is pushed into the cabinet to be placed on a corresponding dividing component of the plurality of dividing components, the third limiting component and the fourth limiting component slightly exceed tail end of the dividing component to fix the shelf board.

In some embodiments, the sliding rail includes an upper half sliding rail and a lower half sliding rail, and the height between the upper half sliding rail and the lower half sliding rail allows the shelf board to be pushed into the cabinet within a predetermined angle range to be placed on the lower half sliding rail.

In some embodiments, each shelf board includes a first limiting component and a second limiting component respectively disposed at two ends of a first side of a lower surface of the shelf board, wherein the first limiting component and the second limiting component each include a tenon towards an inner side of the cabinet.

In some embodiments, when the shelf board is completely pushed into the sliding rail, a bottom of the tenon of each of the first limiting component and the second limiting component presses against an upper edge of the lower half sliding rails, wherein, when the first side of the shelf board is pressed down, the bottom of the tenon of each of the first limiting component and the second limiting component is located below the lower half sliding rail to press against the lower half sliding rail to fix the shelf board.

In some embodiments, each dividing component disposed in the cabinet includes front fixed columns and rear fixed columns, and a first side of each shelf board and a second side opposite to the first side include front grooves and rear grooves, the front grooves and the rear grooves are respectively inverted-U-shaped and inverted-L-shaped, and the front fixed columns and the rear fixed columns of the cabinet are respectively snapped into the front grooves and the rear grooves of the shelf board, so that the shelf board is horizontally placed in the cabinet.

In some embodiments, the first side of each shelf board is provided with a fixing member next to the front groove, and when the shelf board is horizontally placed in the cabinet, the fixing member is snapped into a corresponding groove provided in the cabinet to fix the shelf board.

The present invention further provides a method for storing an object in a smart locker, including: activating a shelving mode of the smart locker to open available locker compartments of the smart locker; obtaining an order number and size information of a target object, and placing the target object into one or more first locker compartments of the available locker compartments of the smart locker according to the size information; scanning a bar code of the one or more first locker compartment to link the order number with the bar code of the one or more first locker compartments; closing locker doors of the available locker compartments to control the smart locker to switch from the shelving mode to a pickup mode.

The present invention further provides a method for storing an object in a smart locker, including: activating a shelving mode of the smart locker; obtaining an order number, buyer information and size information of a target object; selecting one or more first locker compartments of available locker compartments of the smart locker according to the size information, and opening locker doors of the one or more first locker compartments; placing the target object into the adjacent one or more first locker compartments; closing the locker doors of the adjacent one or more first locker compartments to link the order number with the one or more first locker compartments, and controlling the smart locker to switch from the shelving mode to a pickup mode; if the locker compartment used by the same buyer has a space for placing an additional parcel, opening, by the smart locker, the same locker compartment for the same buyer, so that a new shelving person places a parcel delivered later into the locker compartment for the same buyer.

In some embodiments, the one or more first locker compartments are one or more vertically adjacent available locker compartments of the available locker compartments.

In some embodiments, a first inner surface of the cabinet of the smart locker and a second inner surface opposite to the first inner surface are correspondingly provided with a plurality of dividing components, and the smart locker includes one or more shelf boards to cooperate with the plurality of dividing components to vertically divide the storage space of the cabinet into the one or more locker compartments.

In some embodiments, when a locker door corresponding to an adjacent locker compartment of a specific locker compartment of the smart locker is closed, a position of a corresponding shelf board that forms the adjacent locker compartment in the specific locker compartment is limited by the locker door corresponding to the adjacent locker compartment.

BRIEF DESCRIPTION OF THE DRAWINGS

FIGS. 8A-8C are schematic diagrams of user interfaces for a payment on delivery order during pickup by using a smart locker system according to an embodiment of the present invention.

FIGS. 10A-10D are schematic diagrams of user interfaces for mixed orders during pickup by using a smart locker system according to an embodiment of the present invention.

DETAILED DESCRIPTION

Exemplary embodiments of the present invention will be described below for the purpose of describing the basic spirit of the present invention, instead of limiting the present invention. The actual invention content should refer to the patent scope of the claims.

It is to be understood that the words "include" and "comprise" used herein are intended to indicate the existence of specific technical features, numerical values, method steps, operation processes, elements, and/or assemblies, but do not exclude the possibility of adding more technical features, numerical values, method steps, operation processes, elements, and/or assemblies, or any combination thereof.

The words such as "first" "second" and "third" in the claims are intended to modify elements within the claims, rather than indicate a priority order or preceding relationship between them, or indicate that one element precedes another, or the chronological order in which method steps are executed, and are only intended to distinguish elements with the same name.

Figure 1:
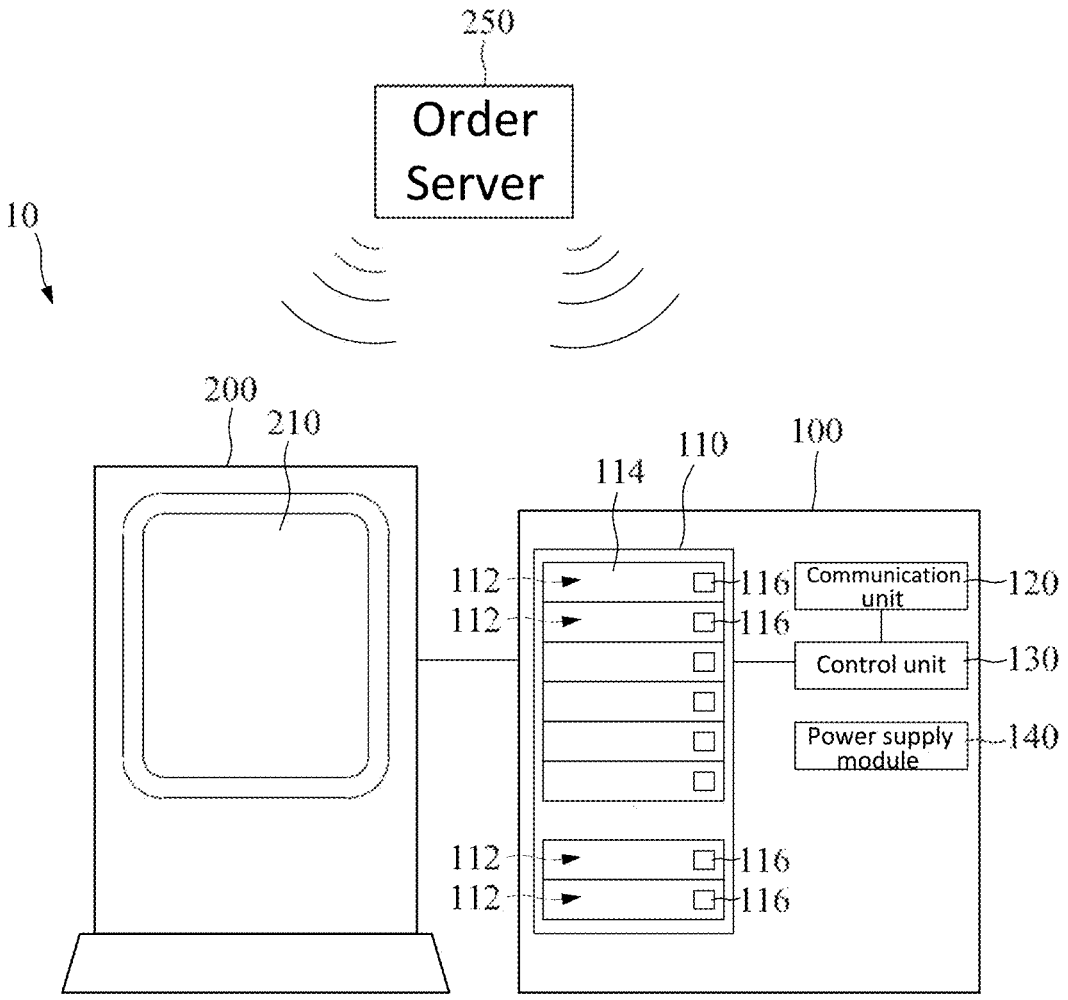
FIG. 1 is a block diagram of a smart locker system according to an embodiment of the present invention.

FIG. 1 is a block diagram of a smart locker system according to an embodiment of the present invention.

Referring to FIG. 1, the smart locker system 10 includes a smart locker 100 and an electronic device 200. In one embodiment, the smart locker 100 includes a cabinet 110, a communication unit 120, a control unit 130, and a power supply module 140. The communication unit 120 and the power supply module 140 are electrically connected to the control unit 130. The power supply module 140 is connected to a power supply, such as a commercial power supply, a solar cell or a mobile power supply, or is provided with a battery for providing electric power required for the elements of the smart locker 100, but the present invention is not limited thereto.

The cabinet 110 includes a plurality of locker doors 114. A door lock device 116 is provided at a corresponding opening position of each locker door 114 of the cabinet 110 to fix and lock the corresponding locker door 114. The door lock device 116 may be controlled to lock or unlock by the control unit 130. Each locker door 114 has a corresponding locker compartment 112 in the cabinet 110. Each of locker compartments 112 may be separated from each other by a shelf board (not shown in FIG. 1). A first inner surface (such as right inner surface) and a second inner surface (such as left inner surface) of the cabinet 110 are correspondingly provided with a plurality of dividing components (such as sliding rails or fixed columns). The shelf board is placed or laid out on the plurality of dividing components to vertically divide a storage space of the cabinet 110 into one or more locker compartments 112, the details of which will be described below.

The communication unit 120 may comprise, for example, a transceiver for being communicatively connected to the electronic device 200 and an order server 250 through wired network protocols and/or wireless network protocols. The control unit 130 may comprise, for example, a general-purpose processor, a central processing unit or a microcontroller, but the present invention is not limited thereto. The order server 250 may be, for example, a cloud server to store order information (such as order type, order number, payable amount and consignee's phone number) for each user, storage information (such as locker compartment number and parcel volume) for each locker compartment 112 in the smart locker 100, and corresponding order information.

The electronic device 200 may be, for example, a comprehensive electronic check-in/payment machine, which may be implemented, for example, by a personal computer, tablet computer, etc. The electronic device 200 has a touch screen 210 for displaying various user operation interfaces to provide functions such as check-in for pickup orders, identity verification and payment, opening of the locker door 114 of the smart locker 100, and printing of receipts. The functions and corresponding user operation interfaces will be detailed below. The electronic device 200 further includes a processor and a communication unit (not shown in FIG. 1). The processor is configured to execute a predetermined program code to control various operations of the electronic device 200. The electronic device 200 may be communicatively connected with the smart locker 100 through the communication unit (for example, which may be wired or wireless connection). In other embodiments, the electronic device 200 may be communicatively connected with the order server 250 through the communication unit (for example, which may be wired connection or wireless connection) to obtain order information related to the locker compartment that stores the article therein of the smart locker 110, such as order type, order number, locker compartment number, parcel volume, consignee's phone number, pickup verification code, payable amount and etc., but the present invention is not limited thereto.

In some embodiments, if a pickup order of a user is a non cash on delivery (non-COD) order, the user may perform operations related to the non-COD pickup order on the touch screen 210 of electronic device 200, such as entering the consignee's phone number, entering the pickup verification code, confirming the pickup order, confirming the completion of the order, and opening one or more locker doors 114 corresponding to the pickup order, etc.

In some embodiments, the electronic device 200 has a cash on delivery function, which includes a coin machine/banknote machine (not shown in FIG. 1) to allow the user to input the payable amount of the cash on delivery order (for example, insert coins or banknotes). If the pickup order of the user is cash on delivery (COD), the user may perform operations related to the cash on delivery pickup order on the touch screen 210 of the electronic device 200, such as entering the consignee's phone number, inputting the payable amount, confirming the completion of the order, and opening one or more locker doors 114 corresponding to the pickup order, etc. In addition, the electronic device 200 further has a printing function for printing pickup receipts for cash on delivery orders and non-cash on delivery orders.

In some embodiments, there is a communication link between the smart locker 100 and the electronic device 200, and the electronic device 200 can open one or more locker doors 114 in the smart locker 100 based on specific signals (such as order number, consignee's phone number and pickup verification code) entered by the user (e.g., consignee) to allow the user to pick up the article stored in one or more locker compartments 112 in the smart locker 100.

Figure 2A:
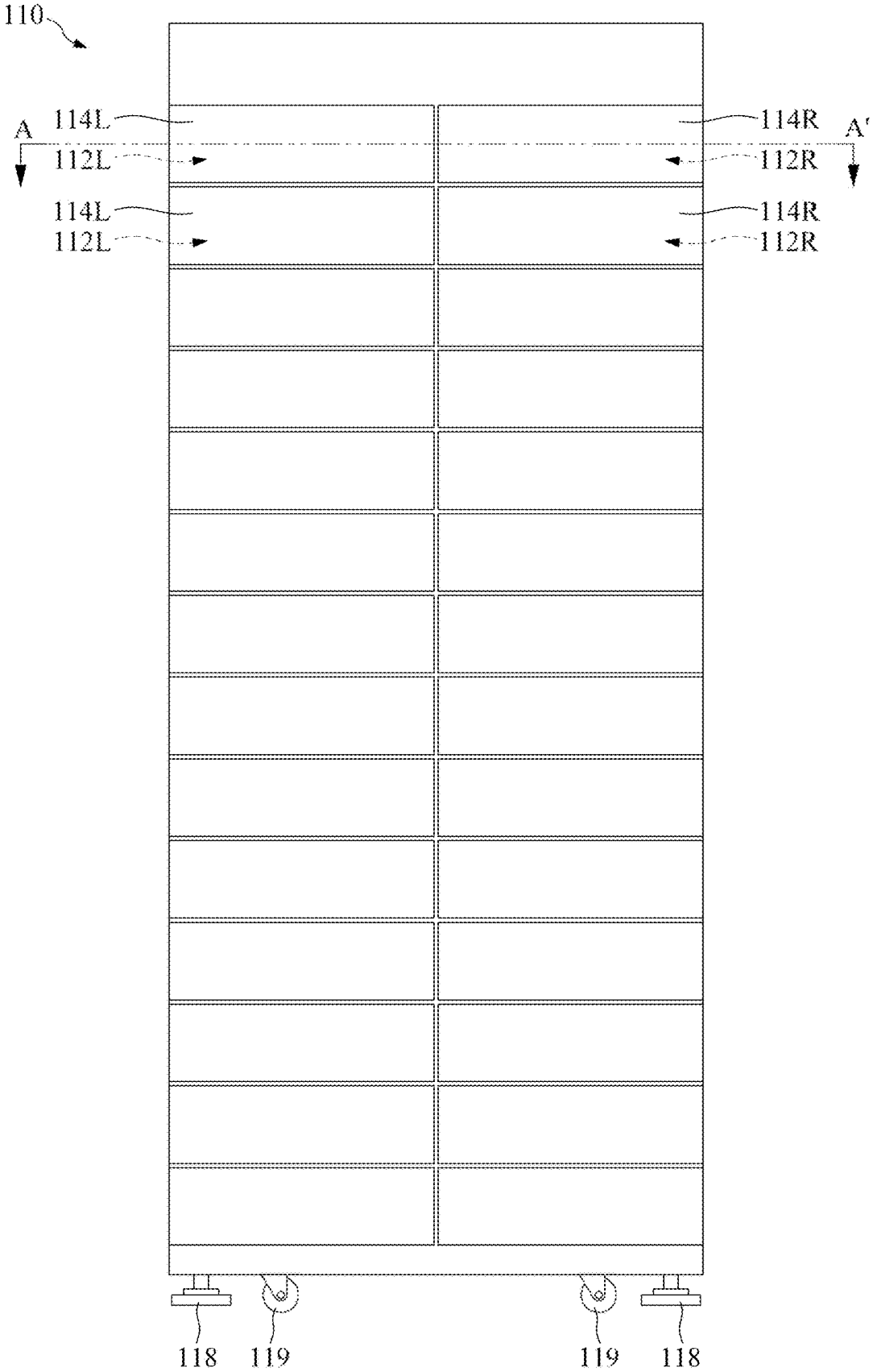
FIG. 2A is a front view of a cabinet 110 according to an embodiment of the present invention illustrated in FIG. 1.
Figure 2B:
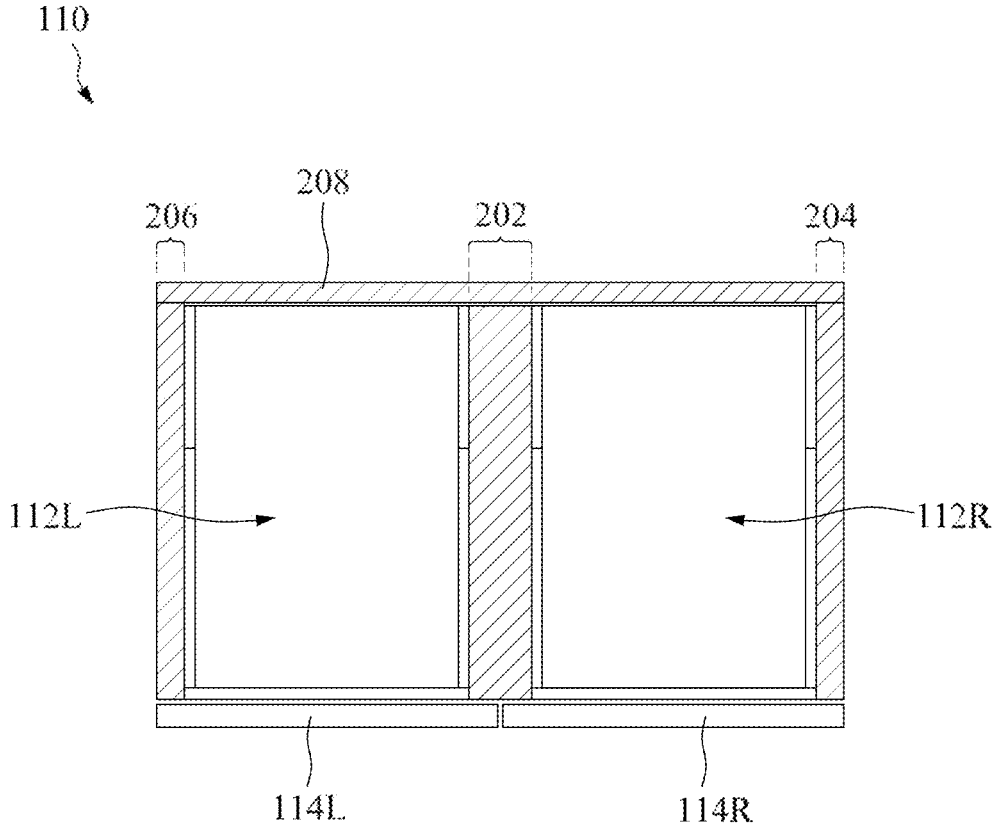
FIG. 2B is a sectional top view of a cabinet 110 along line A-A' according to an embodiment of the present invention illustrated in FIG. 1.

FIG. 2A is a front view of a cabinet 110 according to an embodiment of the present invention illustrated in FIG. 1. FIG. 2B is a sectional top view of a cabinet 110 along line A-A' according to an embodiment of the present invention illustrated in FIG. 1. Please refer to FIG. 1 and FIGS. 2A-2B at the same time.

Referring to FIG. 2A, the cabinet 110 may include left locker compartments 112L and corresponding locker doors 114L, and right locker compartments 112R and corresponding locker doors 114R. A bottom of the cabinet 110 is provided with adjustable feet 118 and castors 120. The castors 120 can facilitate the movement of the cabinet 110. The adjustable feet 118 are used to fix the position of the cabinet 110 to prevent the cabinet 110 from sliding and to adjust the height and level of the cabinet 110 according to the ground level.

A sectional view of the cabinet 110 along line AA' in FIG. 2A is shown in FIG. 2B, wherein the cabinet 110 includes a middle partition plate 202, a right side plate 204, a left side plate 206, and a back plate 208. As an example, the storage spaces of the locker compartments 112L on the left side are formed by the back plate 208, the middle partition plate 202, the left side plate 206, and the shelf boards (not shown in FIGS. 2A-2B) above and below the locker compartments 112L. Similarly, the storage spaces of the locker compartments 112R on the right side are formed by the back plate 208, the middle partition plate 202, the right side plate 204, and the shelf boards (not shown in FIGS. 2A-2B) above and below the locker compartments 112R.

In some embodiments, the door lock devices 116 corresponding to individual locker doors 114L, 114R may be disposed at different positions according to the actual situation (such as the direction of opening the doors). As an example, if the locker doors 114R are designed to be opened rightwards (that is, the locker doors 114R open to the right), the door lock devices 116 corresponding to the locker doors 114R may be disposed on an inner side of the middle partition plate 202 or in corresponding groove of the middle partition plate 202. If the locker doors 114R are designed to be opened leftwards (that is, the lock doors 114R open to the left), the door lock devices 116 corresponding to the locker doors 114R are disposed on an inner or outer side of the right side plate 204 of the cabinet 110, or within the right side plate 204.

Similarly, if the locker doors 114L are designed to be opened rightwards (that is, the locker doors 114L open to the right), the door lock devices 116 corresponding to the locker doors 114R are disposed on an inner or outer side of the left side plate 206 of the cabinet 110, or within the left side plate 206. If the locker doors 114L are designed to the opened leftwards (that is, the locker doors 114L open to the left), the door lock devices 116 corresponding to the locker doors 114R are disposed on an inner side of the middle partition plate 202 of the cabinet 110 or in corresponding groove of the middle partition plate 202.

In the above embodiments, when the door lock devices 116 are disposed in the corresponding grooves of the middle partition plate 202, the right side plate 204 or the left side plate 206 of the cabinet 110, a blocking piece (not shown) is provided in front of the corresponding grooves of the middle partition plate 202, the right side plate 204 or the left side plate 206 of the cabinet 110 from the top to the bottom of the cabinet 110, to prevent users from damaging the door lock devices 116 from the outside.

It should be understood that for the purpose of description, the cabinet 110 in the embodiments illustrated in FIGS. 2A-2B includes two rows of locker compartments 112, such as left locker compartments 112L and right locker compartments 112R. In other embodiments, the cabinet 110 may only include a single row of locker compartments 112 or more rows of locker compartments 112.

Figure 3A:
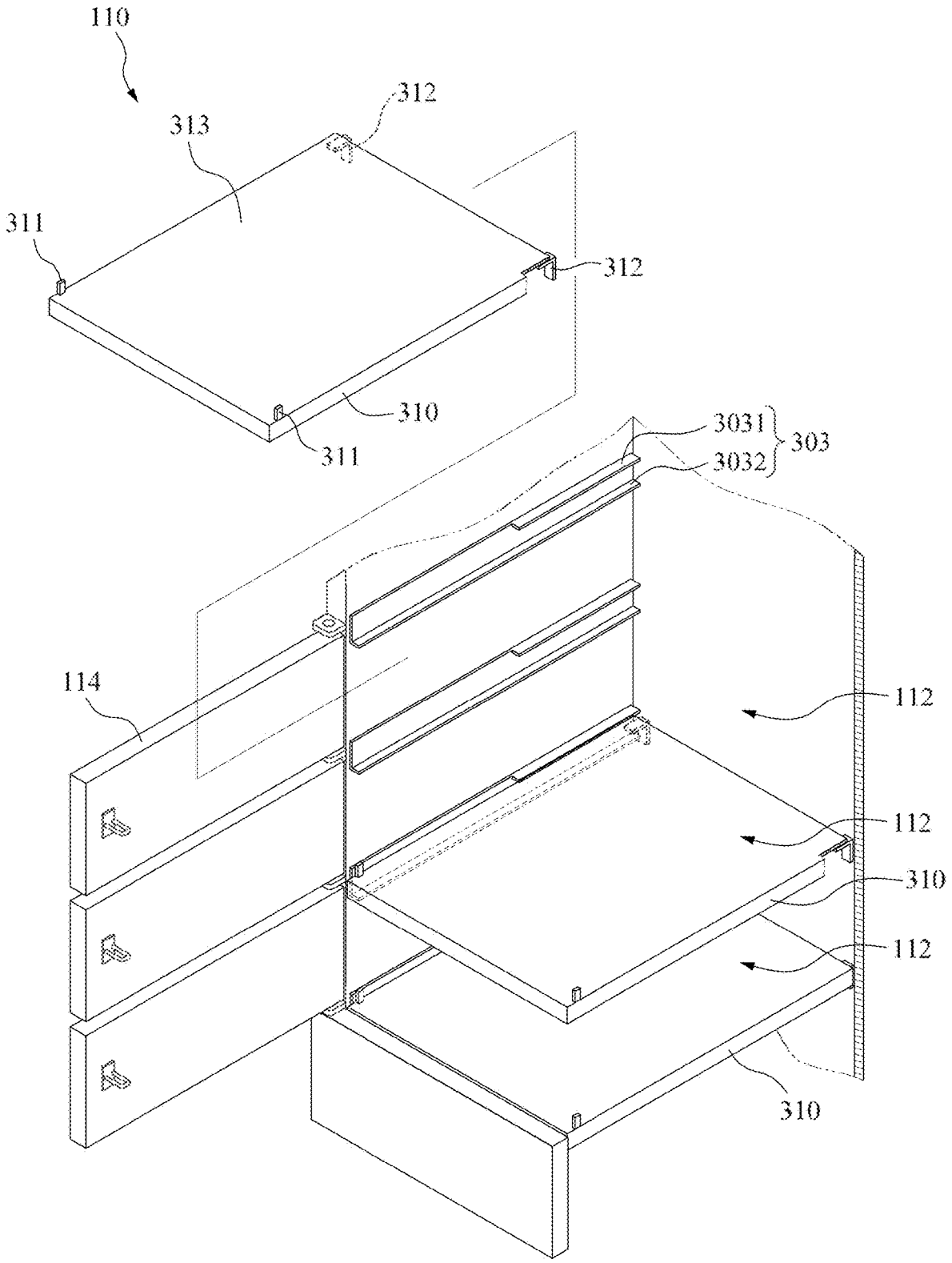
FIG. 3A is a partial perspective schematic diagram of a cabinet 110 according to an embodiment of the present invention.
Figure 3B:
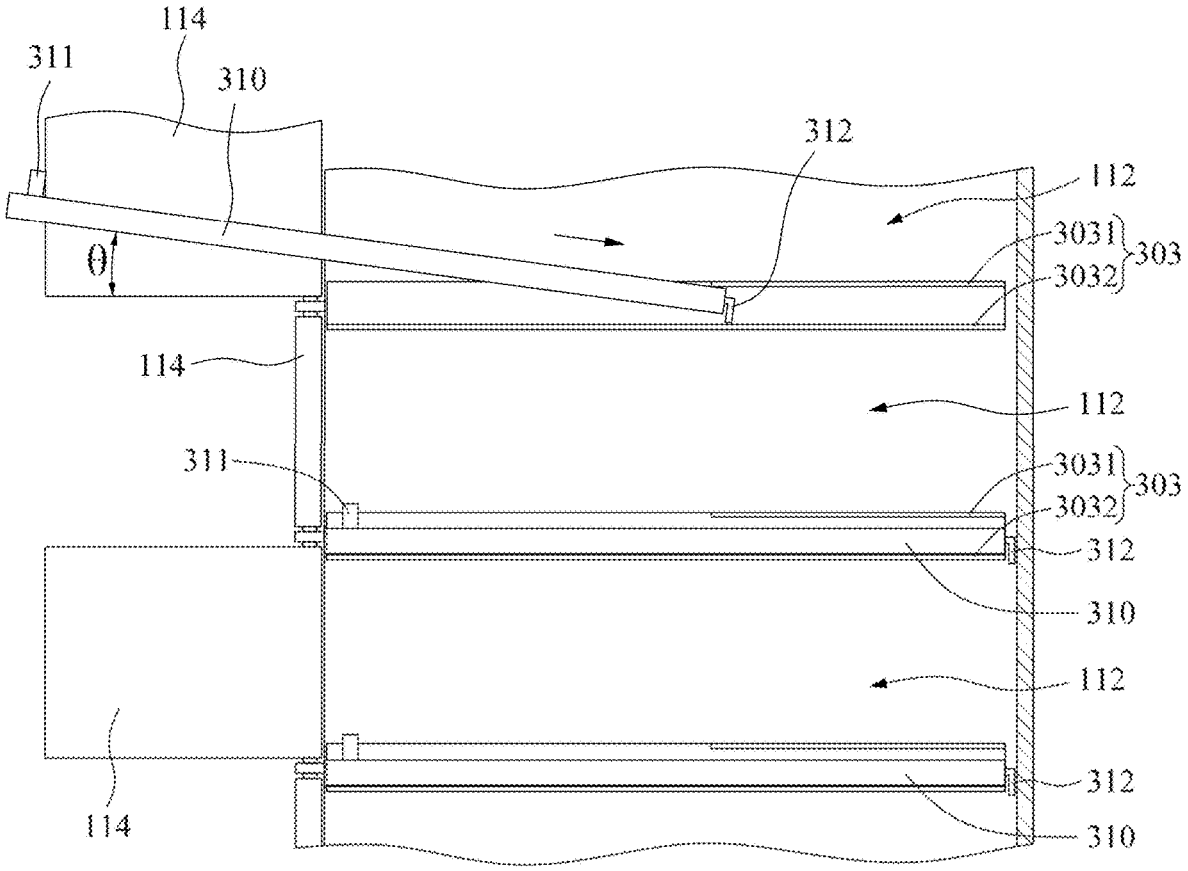
FIG. 3B is a schematic diagram of placing a shelf board 310 according to an embodiment of the present invention illustrated in FIG. 3A.

FIG. 3A is a partial perspective schematic diagram of a cabinet 110 according to an embodiment of the present invention. FIG. 3B is a schematic diagram of placing a shelf board 310 according to an embodiment of the present invention illustrated in FIG. 3A. Please refer to FIGS. 3A-3B at the same time.

Referring to FIG. 3A, the locker doors 114 corresponding to the individual locker compartments 112 of the cabinet 110 are all in an open state, and the shelf board 310 at the upper part of FIG. 3A may be placed on a sliding rail 303 (for example, referred to as C-shaped sliding rail). In a case that each locker compartment is an independent storage space, the upper and lower adjacent locker compartments 112 are separated by the shelf board 310. In some embodiments, the shelf board 310 may be a movable shelf board, a draw-out shelf board, a foldable shelf board, or the like, but the present invention is not limited thereto.

The shelf board 310 includes limiting components 311 and 312. The limiting components 311 are disposed on a first side surface of the shelf board 310 and a second side surface opposite to the first side surface, or are disposed on an upper surface 313 of the shelf board 310 at two ends close to a first side (such as front side). The limiting components 311 have a first height relative to the upper surface 313 of the shelf board 310. The limiting components 312 are disposed on a rear side surface of the shelf board 310 at two ends of a second side opposite to the first side. The limiting components 312 have a second height relative to the lower surface of the shelf board 310. The first height is greater than the second height. In addition, there is a first length between the positions of the limiting components 311 on the upper surface of the shelf board 310 and the first side. In some embodiments, the first height is, for example, 7 mm, the second height is, for example, 3 mm, and the first length is, for example, 7 mm, but the present invention is not limited thereto.

Please refer to FIG. 3B. When the locker door 114 at the upper part is in an open state, the user may push the shelf board 310 into the sliding rail 303 of the locker compartment 112 at the upper part within a predetermined angle range (for example, within a range from a horizontal angle of 0 degree to an angle θ). For example, the sliding rail 303 may be composed of an upper half sliding rail 3031 and a lower half sliding rail 3032. The height between the upper half sliding rail 3031 and the lower half sliding rail 3032 is appropriately designed for the user to push the shelf board 310 into the sliding rail 303 within the predetermined angle range to horizontally place it between the upper half sliding rail 3031 and the lower half sliding rail 3032. The length of the shelf board 310 is approximately equal to the length of the lower half sliding rail 3032. Therefore, when the user pushes the entire shelf board 310 into the sliding rail 303, the limiting components 312 will slightly exceed the lower half sliding rail 3032, thus limiting the movement of the shelf board 310 and allowing the shelf board 310 to be placed horizontally on the lower half sliding rail 3032, so as to achieve the limiting function in the horizontal direction.

In addition, the locker door 114 corresponding to the locker compartment 112 in the middle of FIG. 3B is in a closed state, and the shelf board 310 has been horizontally placed on the sliding rail 303 below. At this point, even if the locker door 114 corresponding to the lower locker compartment 112 of FIG. 3B is opened and the sliding rail 303 has a design tolerance, the user can merely move the shelf board 310 of the middle locker compartment 112 slightly, but cannot draw out or remove the shelf board 310 of the middle locker compartment 112 from the lower locker compartment 112. In addition, after placing the shelf board 310 of the upper locker compartment 112 onto the corresponding sliding rail 303, the upper surface 313 of the shelf board 310 is approximately aligned with an upper edge of the locker door 114 corresponding to the middle locker compartment 112 such that it is difficult for the user to apply force to remove the shelf board 310 at the bottom of the upper locker compartment. Therefore, the smart locker 100 of the present embodiment of the invention has an anti-theft function due to the special design of the cabinet 110 and the shelf board 310. In some embodiments, if the user wants to remove the shelf board 310 at the bottom of the middle locker compartment 112 of FIG. 3B, the user needs to open the locker doors 114 of the middle locker compartment 112 and the lower locker compartment 112 at the same time to draw out the shelf board 310 from the sliding rail 303. Following the above embodiments, in a case that the shelf board 310 at the bottom of the middle locker compartment 112 of FIG. 3B has been removed, the user can push the shelf board 310 into the sliding rail 303 at the bottom of the middle locker compartment 112 within the predetermined angle range (such as θ=15°) under the situation where the locker door 114 of the lower locker compartment 312 is closed. When the shelf board 310 is fully pushed into the sliding rail 303, it will be limited from horizontally moving by the limiting components 311-312 and the locker door 114 of the lower locker compartment 112 and the user cannot draw out or remove the shelf board 310 of the middle locker compartment 112 from the lower locker compartment 112, thus achieving the anti-theft function. Similarly, when the locker door 114 of the upper locker compartment 112 of FIG. 3B is closed, due to the design of the limiting components 311 and 312, the user cannot draw out or remove the shelf board 310 at the bottom of the upper locker compartment 112 from the middle locker compartment 112 under the situation that the locker door of the middle locker compartment 112 has been already opened, thus achieving the anti-theft function.

In some embodiments, the shelf board 310 may be made of a metal material such as iron, copper, or other alloys and so on, but the present invention is not limited thereto. In other embodiments, the shelf board 310 may be made of a non-magnetic material such as plastic/plastic steel, aluminum, stainless steel (material containing chromium and nickel), wood etc., but the present invention is not limited thereto.

Figure 4A:
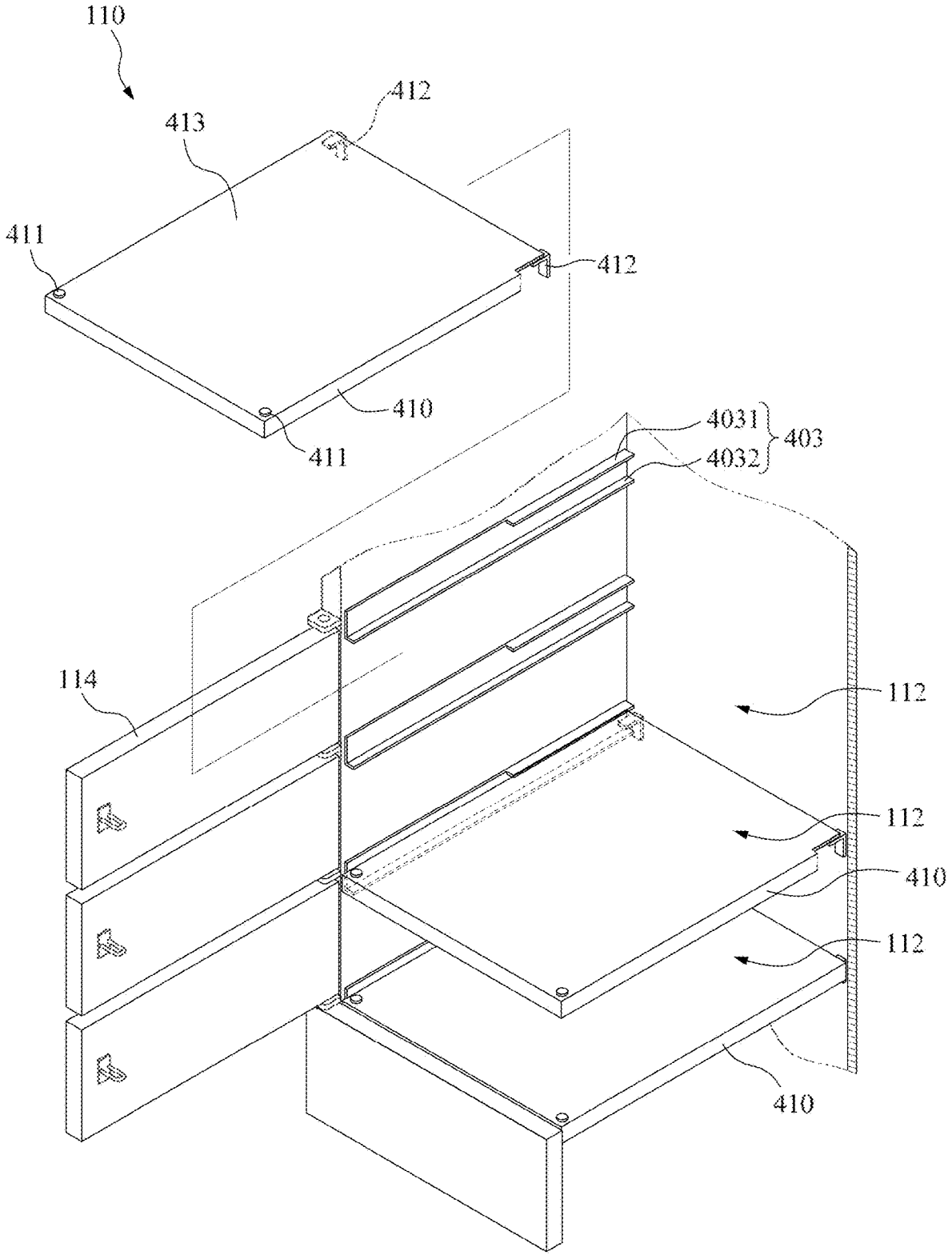
FIG. 4A is a partial perspective schematic diagram of a cabinet 110 according to an embodiment of the present invention.
Figure 4B:
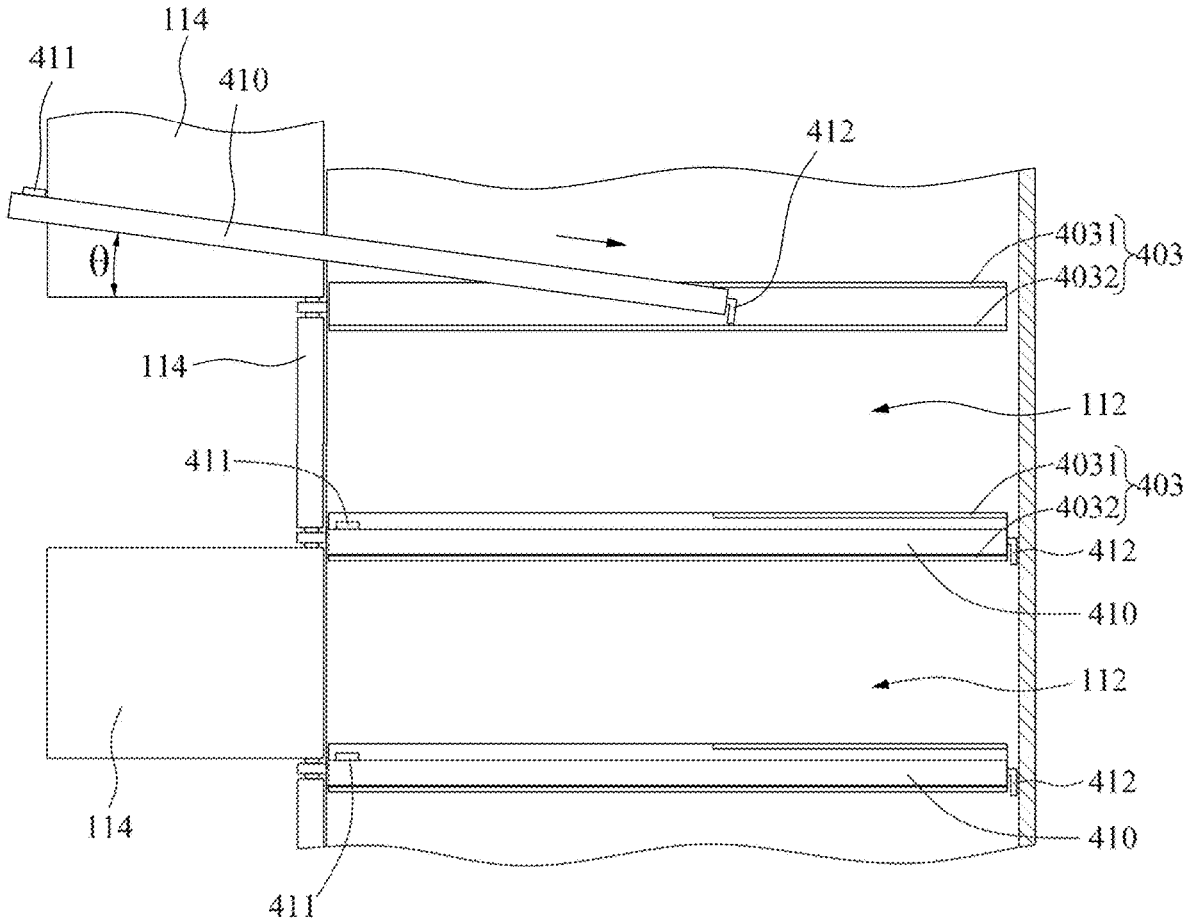
FIG. 4B is a schematic diagram of placing a shelf board 410 according to an embodiment of the present invention illustrated in FIG. 4A.

FIG. 4A is a partial perspective schematic diagram of a cabinet 110 according to an embodiment of the present invention. FIG. 4B is a schematic diagram of placing a shelf board 410 according to an embodiment of the present invention illustrated in FIG. 4A. Please refer to FIGS. 4A-4B at the same time.

The shelf board 410 in FIG. 4A is similar to the shelf board 310 in FIG. 3A, with the difference that the limiting components 411 of the shelf board 410 in FIG. 4A are, for example, bulges. When molding the shelf board 410, it may include the shape of the bulges, so the shelf board 411 can be more easily mass produced in large quantity. For example, the limiting components 411 are disposed on an upper surface 413 of the shelf board 410 at two ends close to a first side (such as front side). The limiting components 411 have a first height relative to the upper surface 413 of the shelf board 410. In some embodiments, the shelf board 410 further includes limiting components 412 disposed on a rear side surface of the shelf board 410 at two ends of a second side opposite to the first side. The limiting components 412 have a second height relative to a lower surface of the shelf board 410. The first height is greater than the second height. In addition, there is a first length between the positions of the limiting components 411 on the upper surface 413 of the shelf board 410 and the first side. In some embodiments, the first height is, for example, 3-7 mm, the second height is, for example, 3 mm, and the first length is, for example, 7 mm, but the present invention is not limited thereto.

Figure 5A:
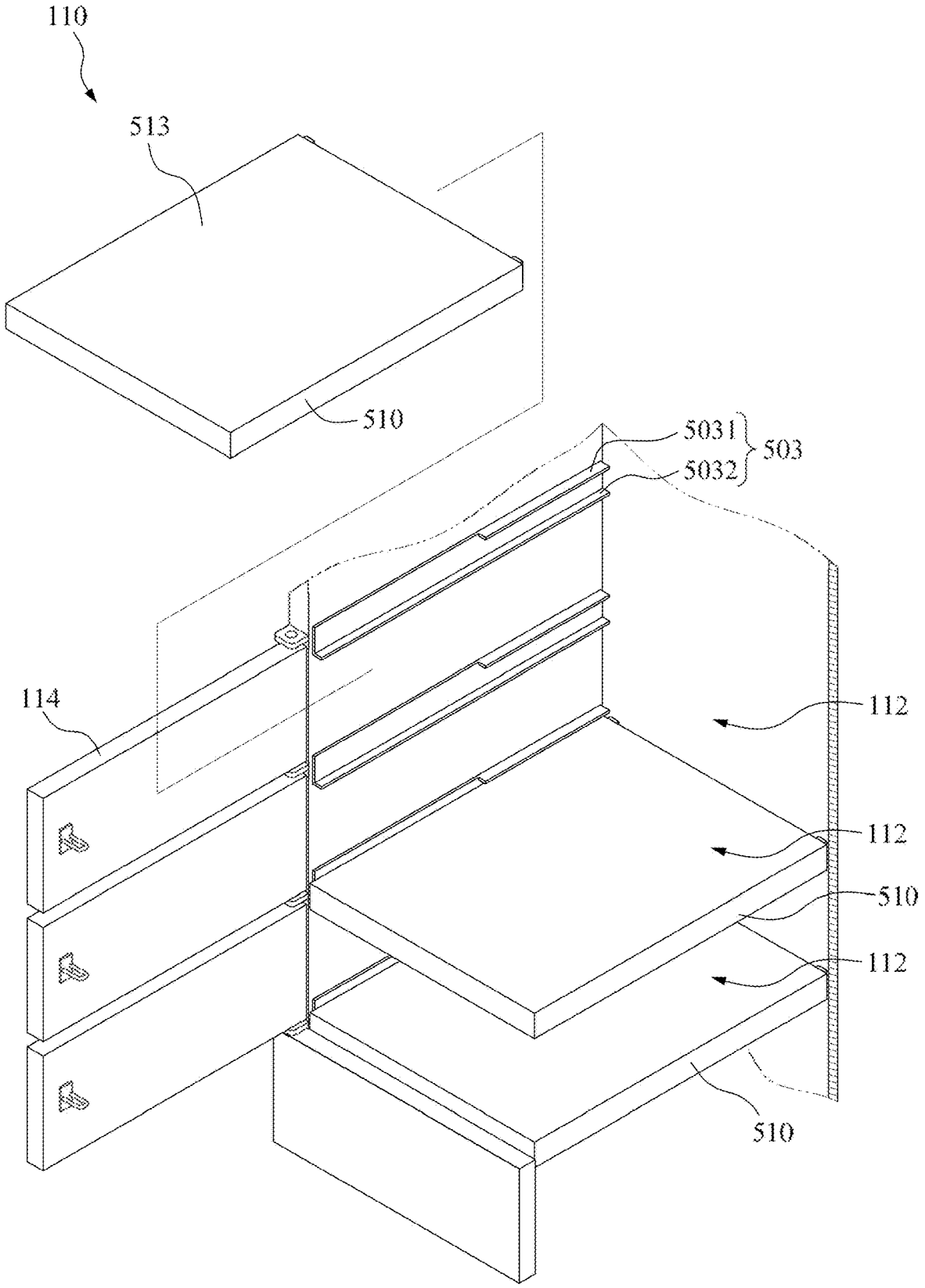
FIG. 5A is a partial perspective schematic diagram of a cabinet 110 according to an embodiment of the present invention.
Figure 5B:
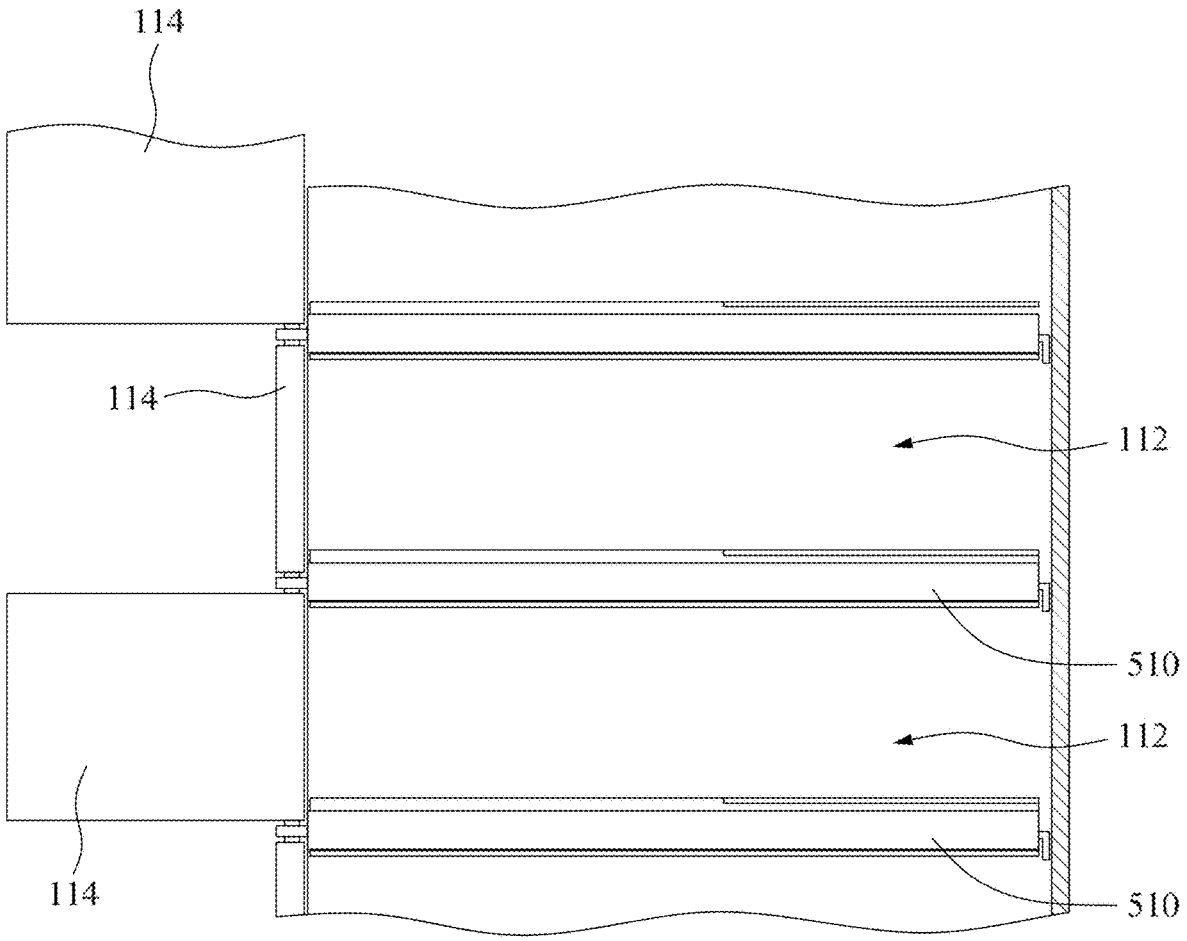
FIG. 5B is a schematic diagram of placing a shelf board 510 according to an embodiment of the present invention illustrated in FIG. 5A.

FIG. 5A is a partial perspective schematic diagram of a cabinet 110 according to an embodiment of the present invention. FIG. 5B is a schematic diagram of placing a shelf board 510 according to an embodiment of the present invention illustrated in FIG. 5A. Please refer to FIGS. 5A-5B at the same time.

The shelf board 510 in FIG. 5A is similar to the shelf board 310 in FIG. 3A except that the shelf board 510 in FIG. 5A does not include limiting components on the front side and the thickness of the shelf board 510 is approximately twice thickness of the shelf board 310.

Please refer to FIG. 5B again. Since the shelf board 510 is thicker, the positions of an upper half sliding rail 5031 and a lower half sliding rail 5032 of a sliding rail 503 are slightly different from the positions of the upper half sliding rail 301 and the lower half sliding rail 302 in FIG. 3A. The positions of the upper half sliding rail 5031 and the lower half sliding rail 5032 may be appropriately designed so that the upper surface 513 of the shelf board 510 is approximately flush with or slightly higher than the upper surface of the locker door 114 corresponding to the lower locker compartment 112 when the shelf board 510 is horizontally placed on the lower half sliding rail 502. Thus, in a case that the locker door 114 corresponding to a certain locker compartment 112 is opened, it is still difficult for the user to apply force to the shelf board 510 at the bottom of the locker compartment 112 to fetch out the shelf board 510. Therefore, the design of the cabinet 110 and the shelf board 510 in the embodiments of the present invention illustrated in FIGS. 5A-5B still has the anti-theft function similar to that in FIGS. 3A-3B and FIGS. 4A-4B.

Figure 6A:
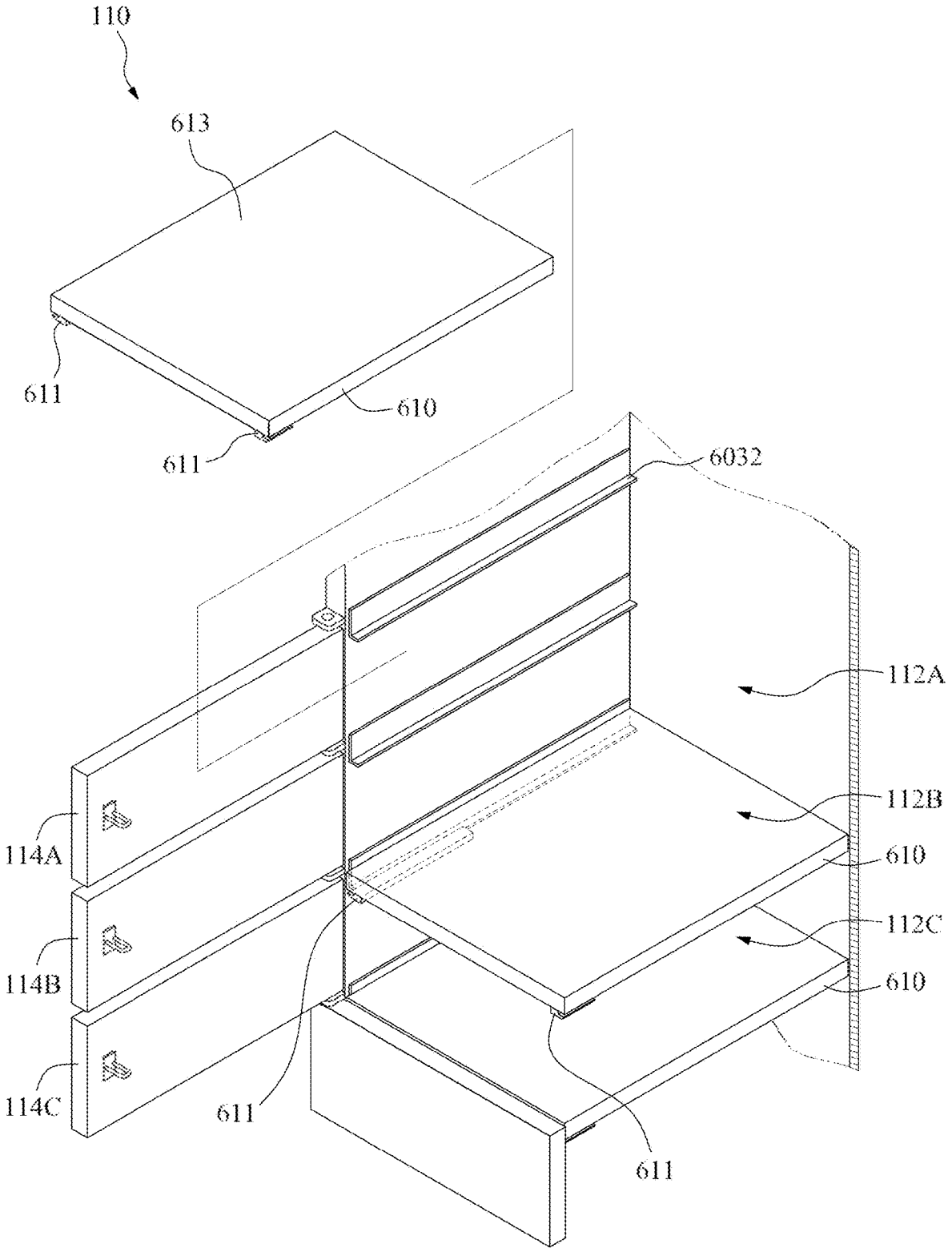
FIG. 6A is a partial perspective schematic diagram of a cabinet 110 according to an embodiment of the present invention.
Figure 6B:
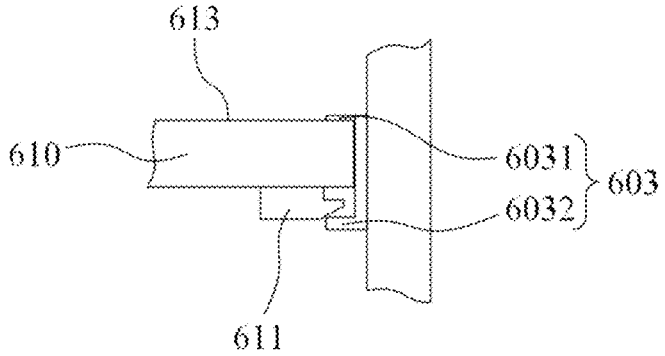
FIGS. 6B-6C are schematic diagrams of fixing a shelf board 610 by using tenons according to an embodiment of the present invention illustrated in FIG. 6A.
Figure 6C:
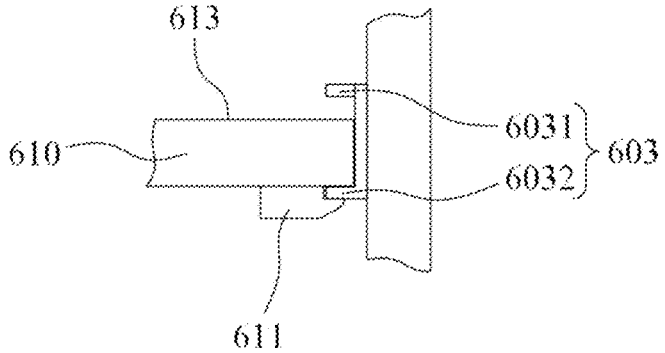

FIG. 6A is a partial perspective schematic diagram of a cabinet 110 according to an embodiment of the present invention. FIGS. 6B-6C are schematic diagrams of fixing a shelf board 610 by using limiting components according to an embodiment of the present invention illustrated in FIG. 6A. Please refer to FIGS. 6A-6C at the same time.

The shelf board 610 in FIG. 6A is similar to the shelf board 310 in FIG. 3A except that the limiting components 611 of the shelf board 610 in FIG. 6A are disposed at two ends of a first side of a lower surface of the shelf board 610. In some embodiments, both the shelf board 610 and the limiting components 611 are made of a plastic steel material, which may be integrally formed during manufacturing, and the limiting components 611 may have some slight elasticity. In some embodiments, the limiting components 611 are, for example, tenons (or C-shaped tenons) with openings facing outwards, for examples, towards the inner side of the cabinet 110.

In some embodiments, the movable shelf board 610 may use a sliding rail 6032 as a dividing component or a supporting component. The sliding rail 6032 is, for example, similar to the lower half sliding rail 3032 in the embodiment illustrated in FIG. 3. When the user pushes the entire shelf board 610 into the sliding rail 6032, a bottom of the tenon of the limiting component 611 will press against an upper edge of the sliding rail 6032, as illustrated in FIG. 6B. At this time, the user can slightly apply force to press down a front end of the shelf board 610, so that a front end of the C-shaped tenon of the limiting component 611 will be deformed due to being squeezed, thus causing the entire shelf board 610 to be placed horizontally on the sliding rail 6032. In addition, the bottom of the tenon of the limiting component 611 will be below the sliding rail 6032 to press against the sliding rail 6032, thus the shelf board 610 may be fixed, as illustrated in FIG. 6C. Therefore, when the shelf board 610 of the locker compartment 112B has been setup and the locker door 114B has been closed, if the locker door 114C corresponding to the locker compartment 112C below the locker compartment 112B has been opened, the user cannot draw out or move the shelf board 610 at the bottom of the locker compartment 112B from the locker compartment 112C at the lower part because the limiting components 611 of the shelf board 610 at the bottom of the locker compartment 112B have pressed against the sliding rails 6032 on the two sides, so that the anti-theft effect is achieved. In other embodiments, the limiting component 611 of the shelf board 610 in FIG. 6A is provided at one end of the first side of the lower surface of the shelf board 610, it means that the anti-theft function can be achieved based on the above mechanism by only using one limiting component 611.

Figure 7A:
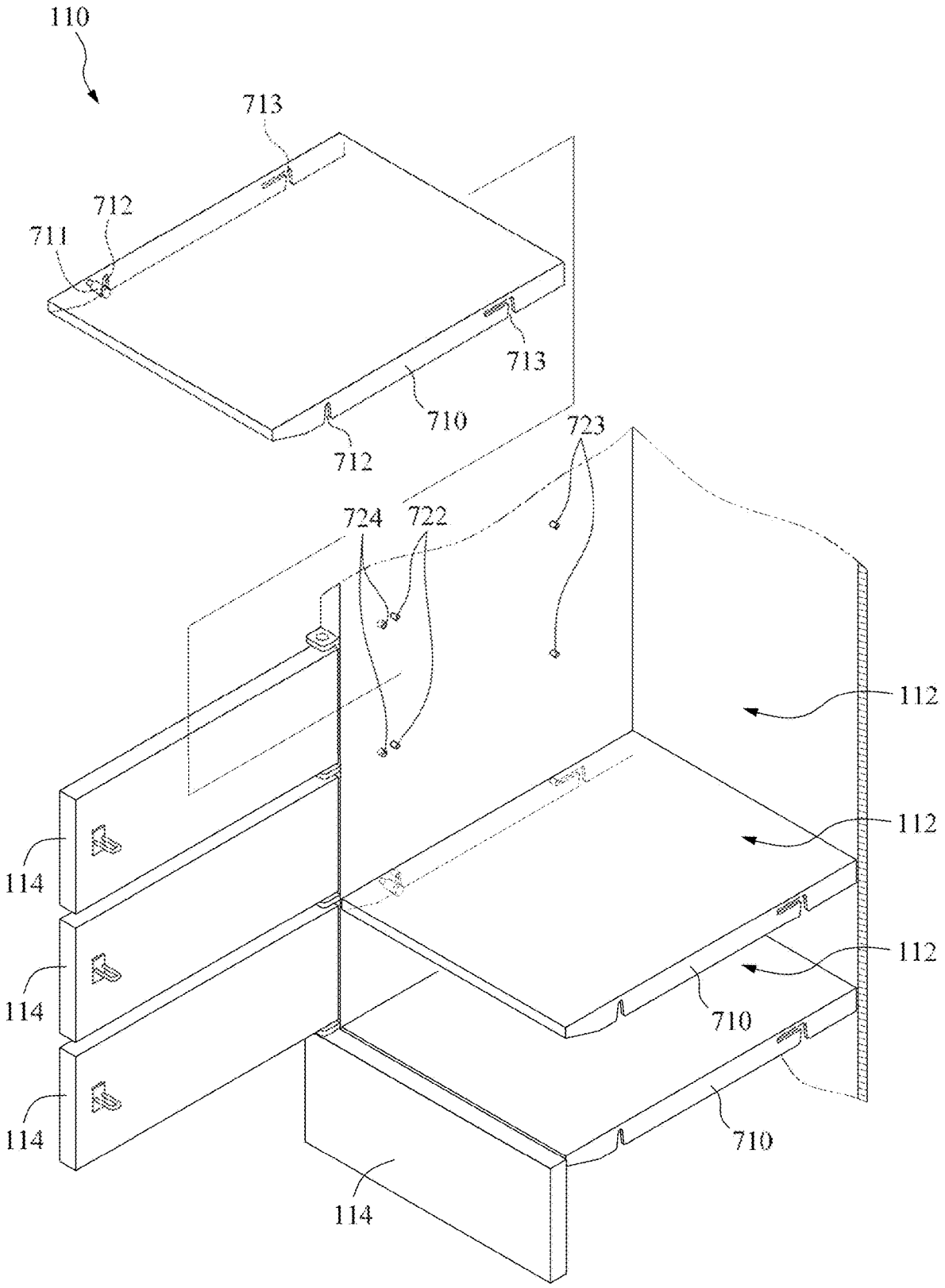
FIG. 7A is a partial perspective schematic diagram of a cabinet 110 according to an embodiment of the present invention.
Figure 7B:
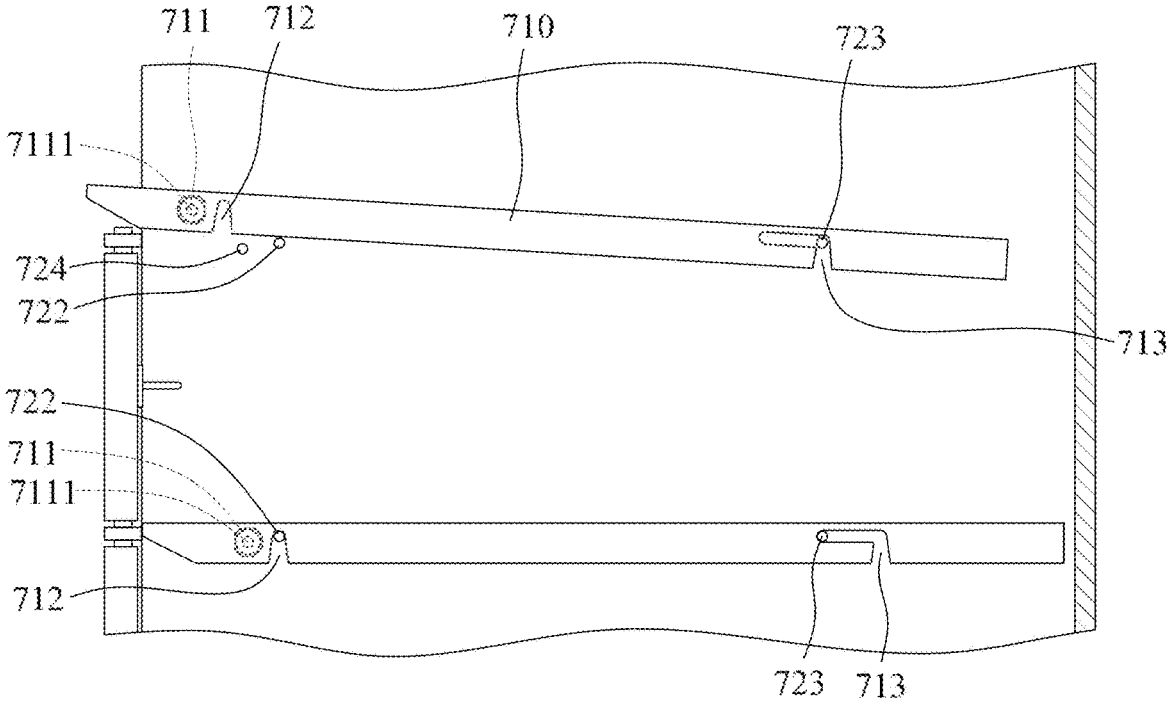
FIG. 7B is a schematic diagram of fixing a shelf board 710 according to an embodiment of the present invention illustrated in FIG. 7A.
Figure 7C:
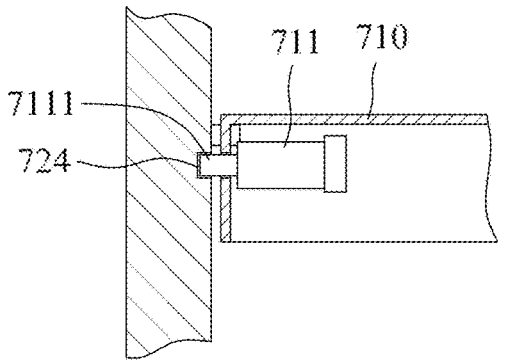
FIGS. 7C-7D are side views of performing a fixing operation by using a fixing member 711 of a shelf board 710 according to an embodiment of the present invention illustrated in FIG. 7A.
Figure 7D:
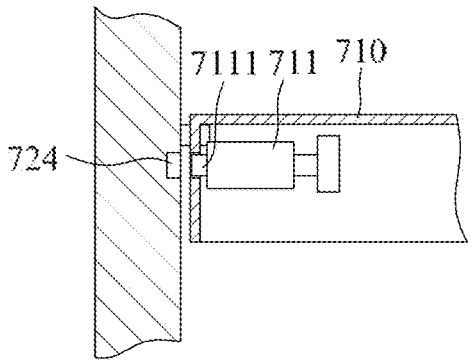

FIG. 7A is a partial perspective schematic diagram of a cabinet 110 according to an embodiment of the present invention. FIG. 7B is a schematic diagram of fixing a shelf board 710 according to an embodiment of the present invention illustrated in FIG. 7A. FIGS. 7C-7D are side views of performing a fixing operation by using a fixing member 711 of a shelf board 710 according to an embodiment of the present invention illustrated in FIG. 7A. Please refer to FIGS. 7A-7D at the same time.

The shelf board 710 in FIG. 7A is placed in a different way from those in FIGS. 3-6. For example, a front end of the shelf board 710 is trapezoidal, and two sides of the shelf board 710 respectively include front grooves 712 and rear grooves 713. The front grooves 712 are inverted-U-shaped, and the rear grooves 713 are inverted-L-shaped. The shelf board 710 further includes an elastic bolt 711 close to the front groove 712 at one side. In addition, left and right sides of each of locker compartments 112 in the cabinet 110 are provided with front fixed columns 722 and rear fixed columns 723, and their relative positions can cause the shelf board 710 to be horizontally placed over the front fixed columns 722 and rear fixed columns 723.

Please refer to FIG. 7B. For example, when the user wants to place the shelf board 710 into the locker compart 112, the rear fixed columns 723 will be first vertically snapped into the rear grooves 713. Next, the user can push the shelf board 710 inwards, so that the rear fixed columns 723 will move horizontally towards the interior of the rear grooves 713, and the front fixed columns 722 will be vertically snapped into the front grooves 712. At this time, the shelf board 710 can be horizontally placed over the front fixed columns 722 and the rear fixed column 723.

Please refer to FIGS. 7C-7D again. The fixing member 711 has a spring to control a protruding portion 7111 of the fixing member 711 to apply force to the outer side of the shelf board 710. When the shelf board 710 in FIG. 7B is horizontally placed over the front fixed columns 722 and the rear fixed columns 723, the protruding portion 7111 of the fixing member 711 will be snapped into a corresponding groove 724, as illustrated in FIG. C. As shown in the shelf board 710 at the upper part of FIG. 7B, the rear fixed columns 723 will be first vertically snapped into the rear grooves 713. At this time, since the fixing member 711 has not yet aligned with the groove 724, the protruding portion 7111 of the fixing member 711 will be slightly retracted, as illustrated in FIG. 7D.

In addition, if the user wants to fetch out the shelf board 710 from the locker compartment 112, the locker doors 114 corresponding to the current locker compartment 112 and the locker compartment 112 below it should be opened at the same time. Next, the user needs to first pull the fixing member 711 out of the groove 724, and then lift the front end of the shelf board 710 to separate the front grooves 712 from the front fixed columns 722. The user pulls the shelf board 710 forwards to enable the rear fixed columns 723 to be located at turning points of the rear grooves 713, and then lifts the rear end of the shelf board 710 to fetch out the shelf board 710.

Figure 8A:
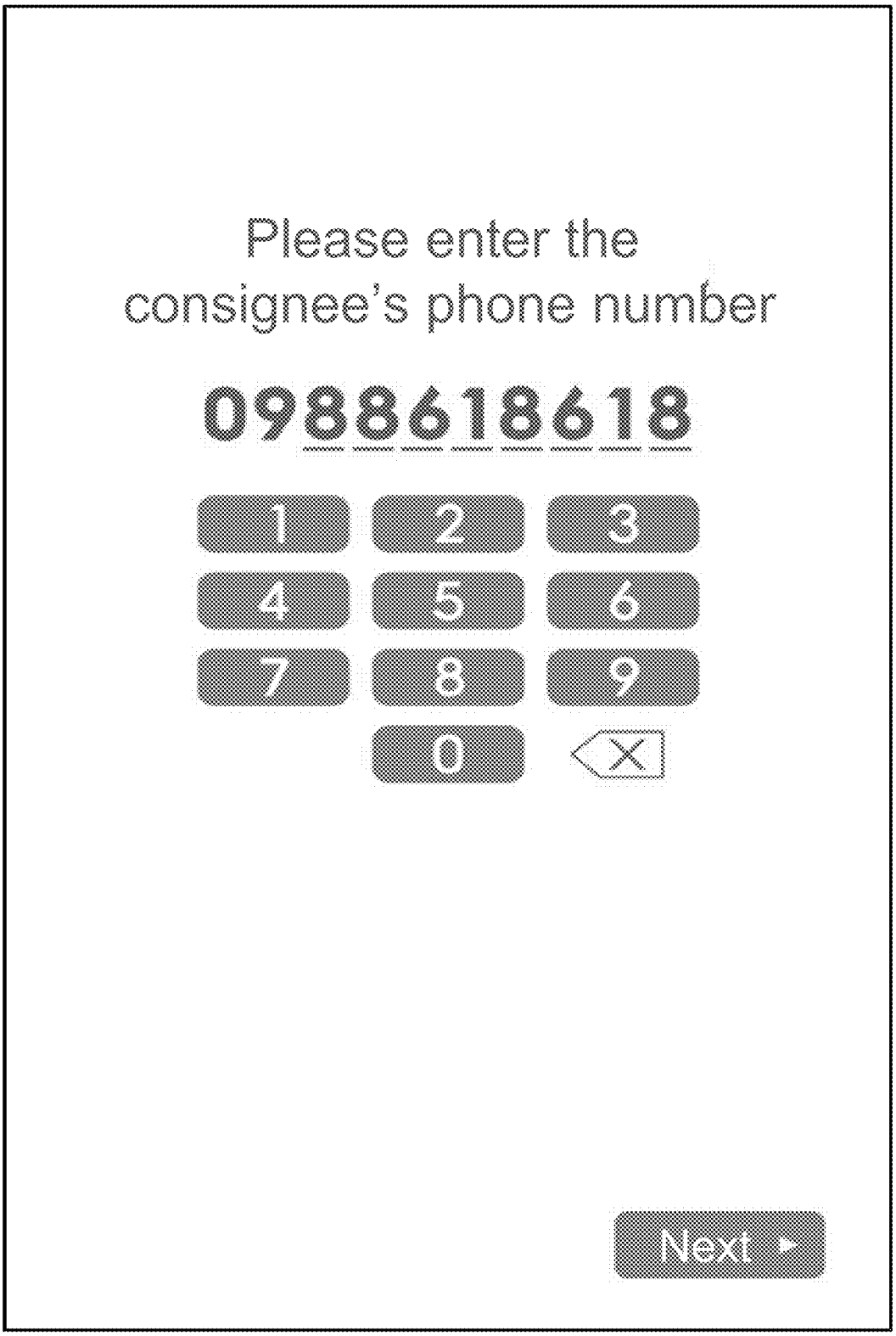
Figure 8C:
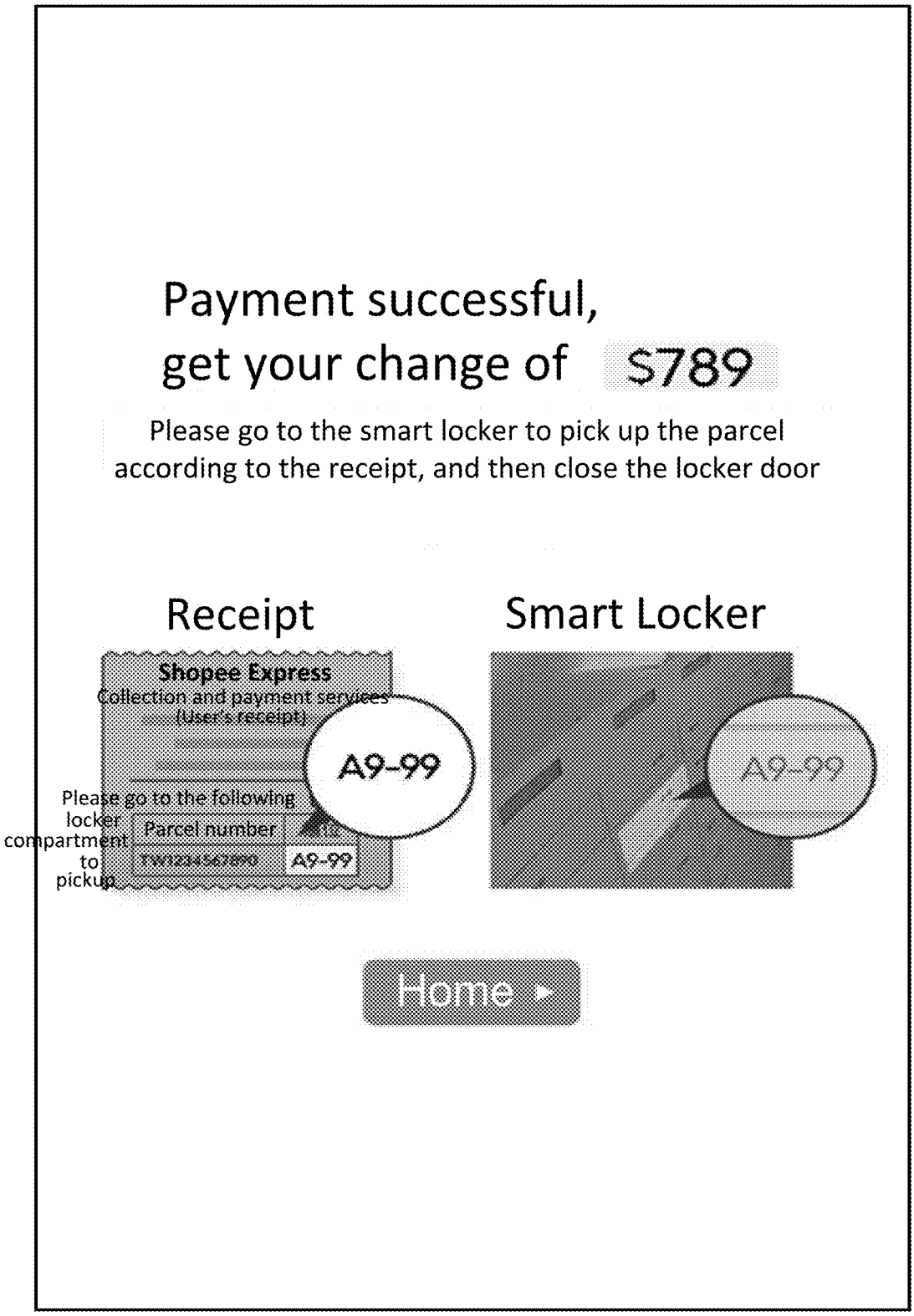
Figure 9A:
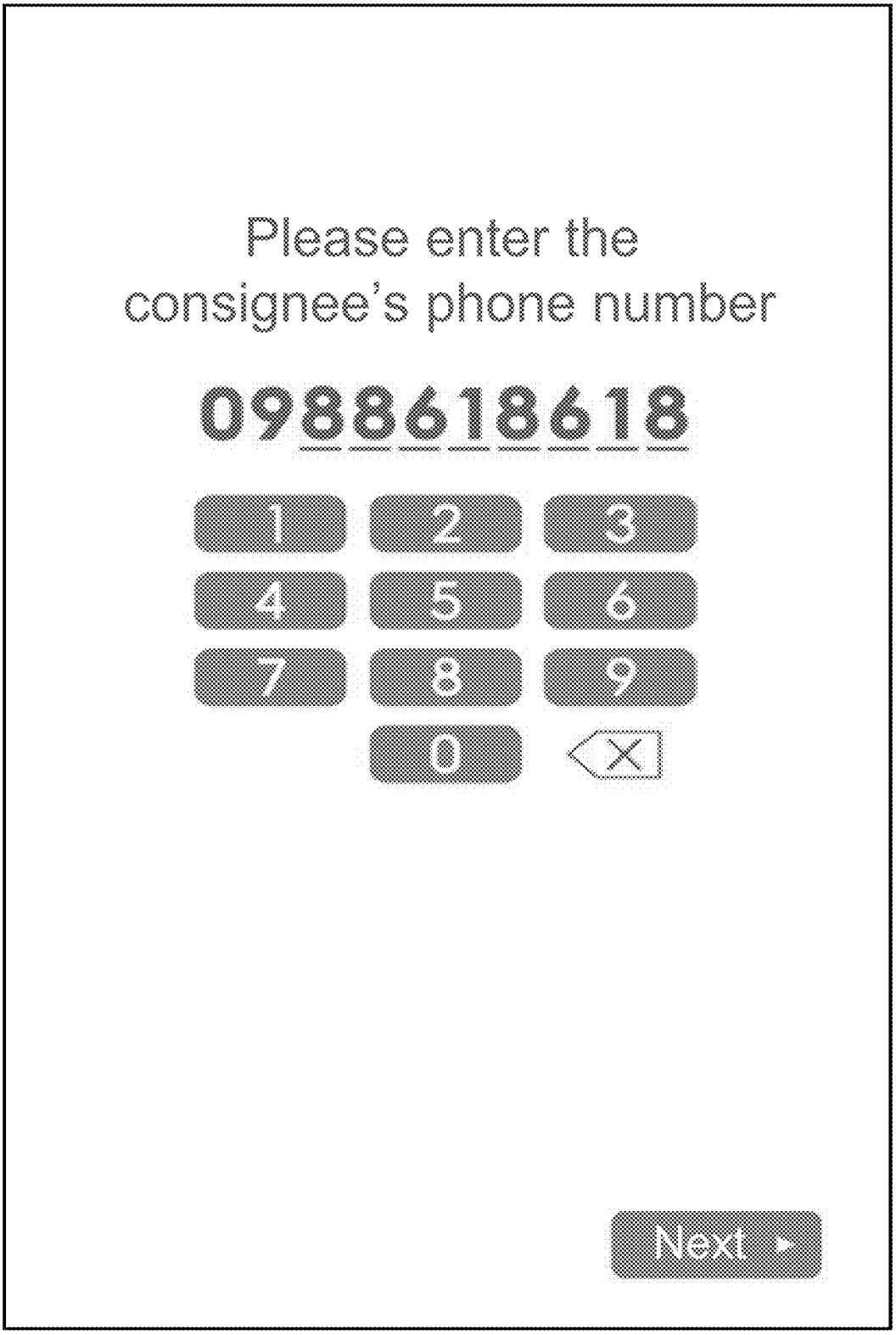
FIGS. 9A-9D are schematic diagrams of user interfaces for a non-payment on delivery order during pickup by using a smart locker system according to an embodiment of the present invention.
Figure 9B:
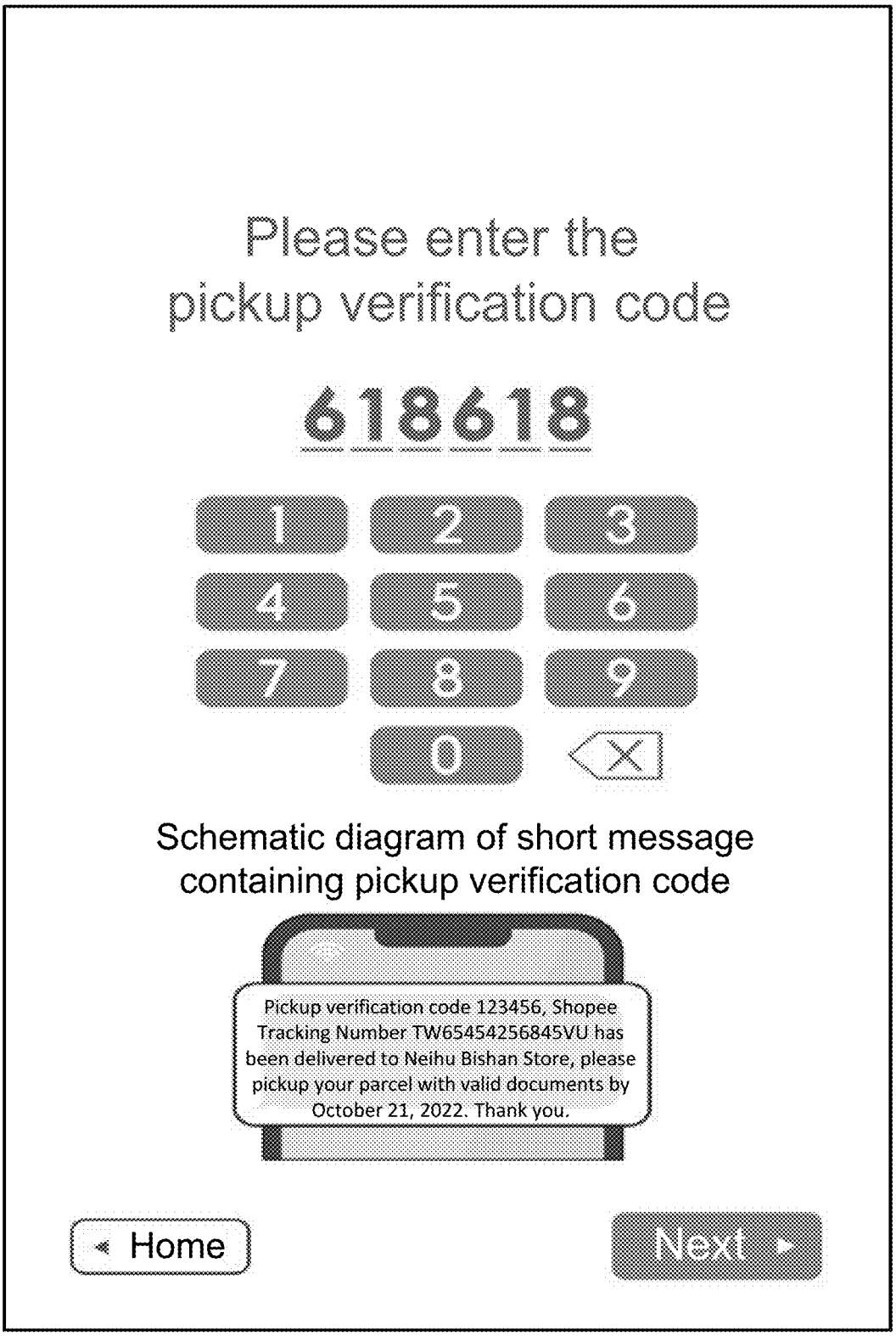
Figure 9C:
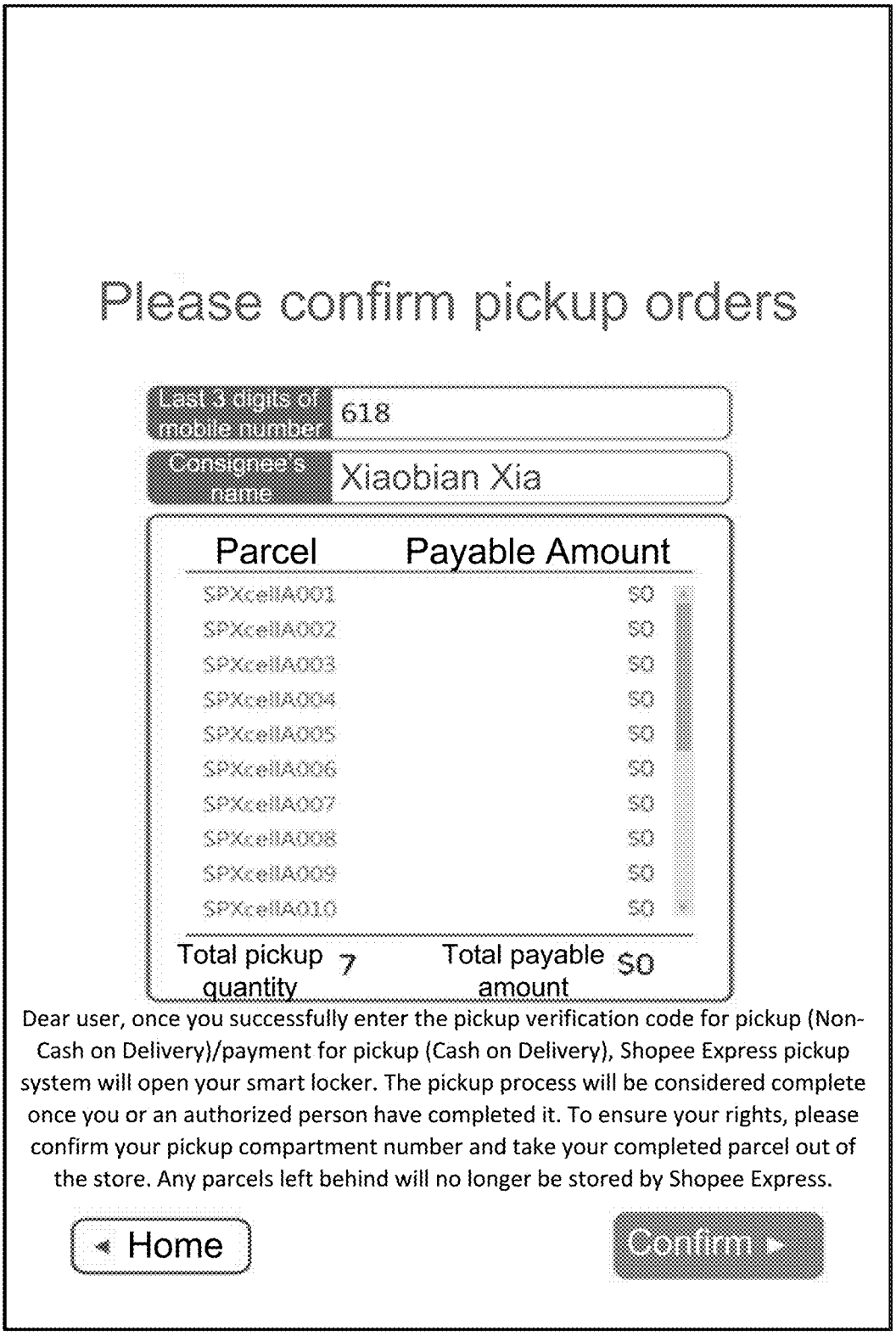
Figure 9D:
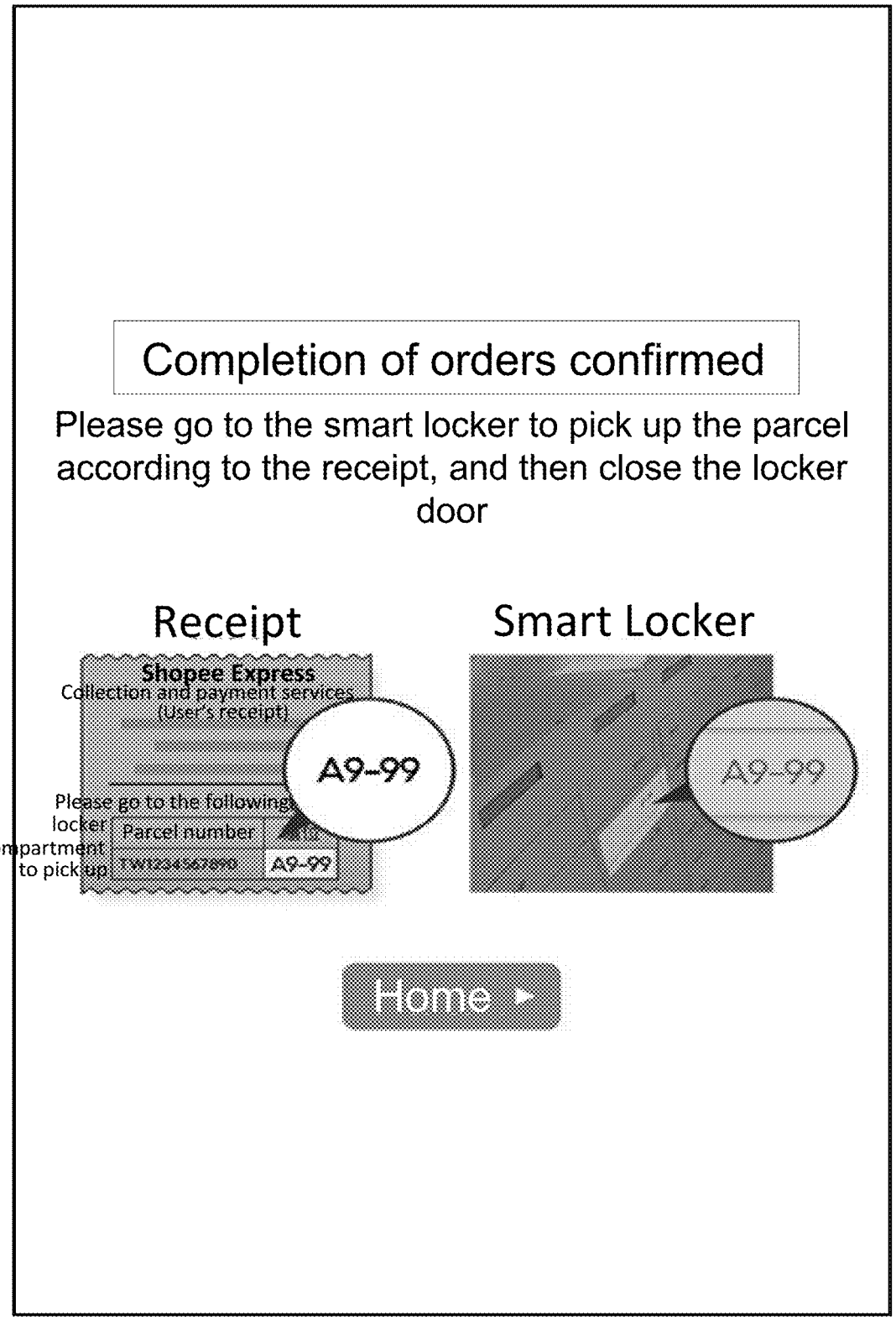
Figure 10A:
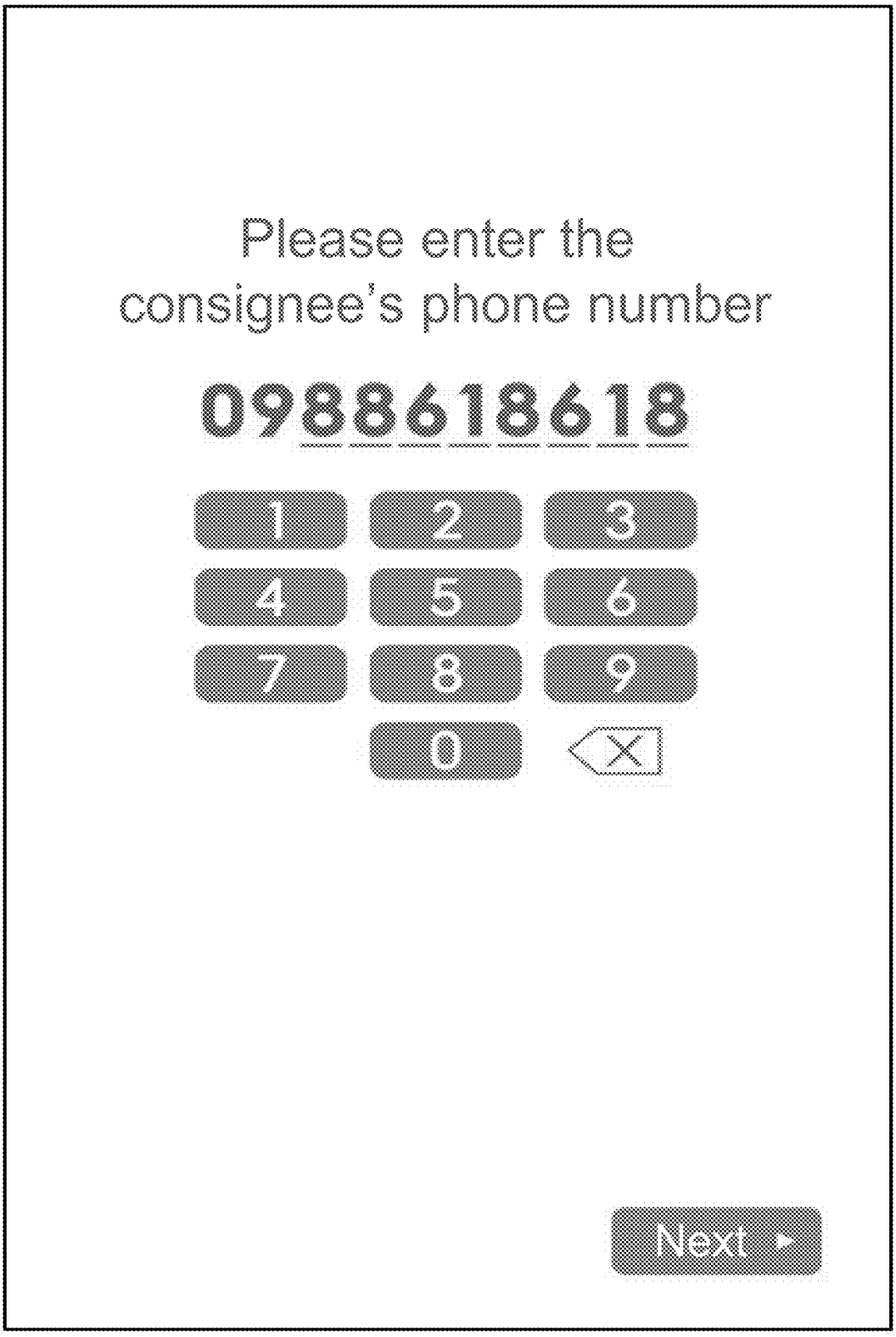
Figure 10B:
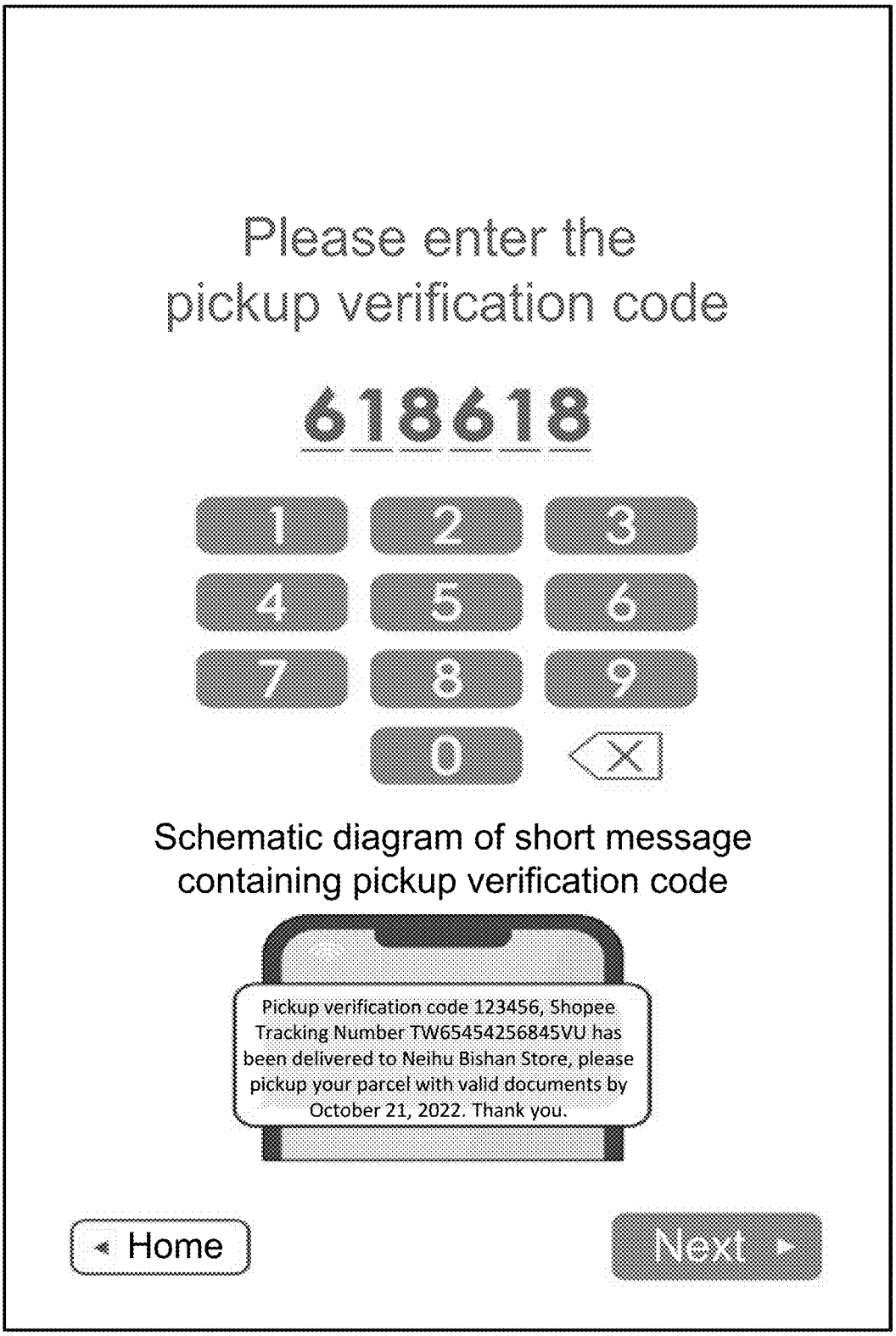
Figure 10D:
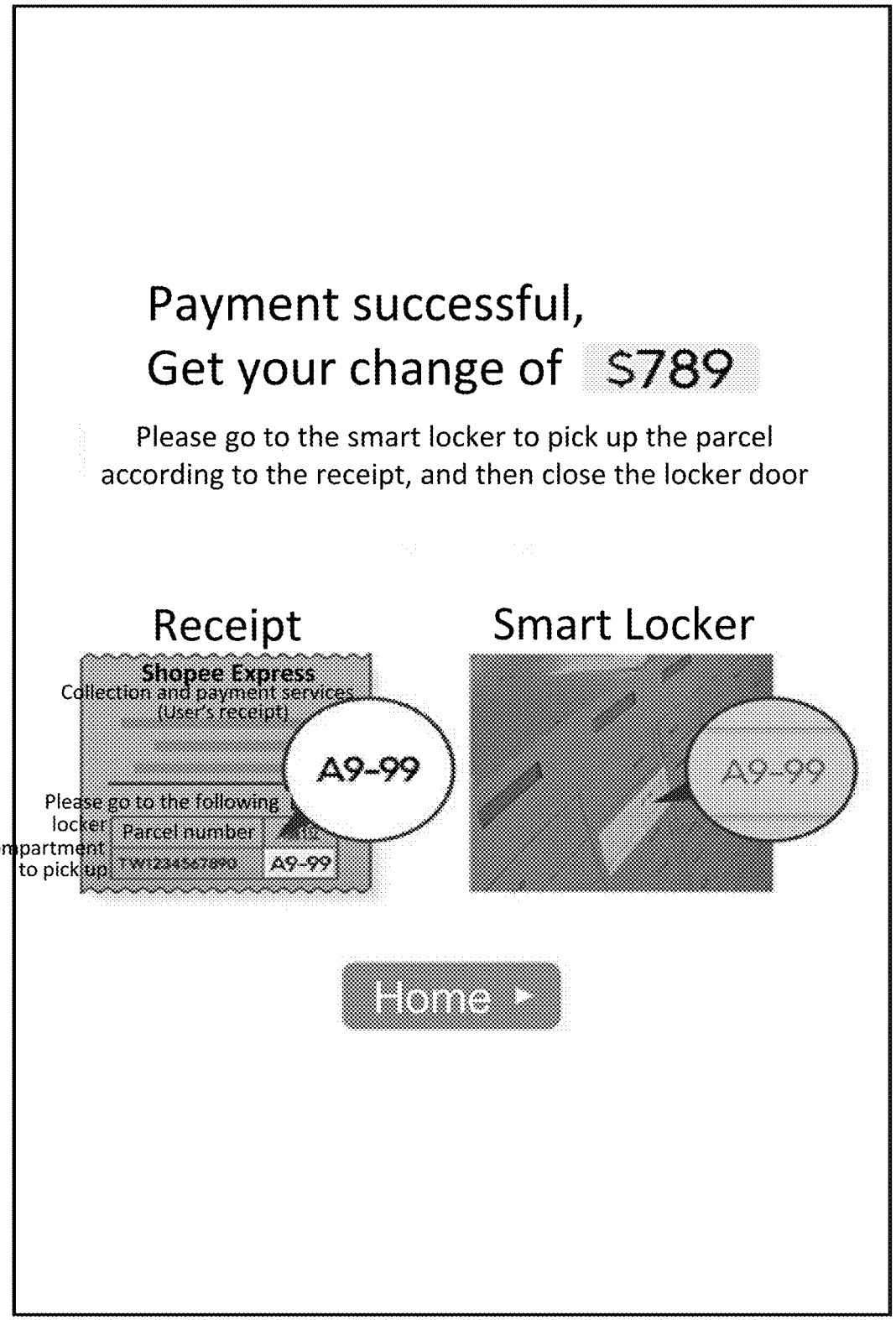

FIGS. 8A-8C are schematic diagrams of user interfaces for a payment on delivery (e.g., cash on delivery) order during pickup by using a smart locker system according to an embodiment of the present invention. Please refer to FIGS. 8A-8C at the same time.

In an embodiment, when the user goes to the smart locker system 10 for the pickup process of a cash on delivery (COD) order, the user may click on the touch screen 210 of the electronic device 200 to select cash on delivery order pickup. At this time, the electronic device 200 will display a user interface illustrated in FIG. 8A on the touch screen 210, allowing the user to enter the consignee's phone number. After the consignee's phone number has been entered, the electronic device 200 sends the consignee's phone number to the order server 250 to verify the order information, and the order server 250 sends back a verification result to the electronic device 200. If the verification is successful, the order server 250 will send back the order information related to the consignee's phone number to the electronic device 200, and the electronic device 200 will display a user interface illustrated in FIG. 8B on the touch screen 210 to display parcel numbers and corresponding payable amounts of all cash on delivery orders corresponding to the consignee's phone number, and display the total pickup quantity and payable amount of all COD orders.

In this embodiment, the electronic device 200 may include a coin machine/banknote machine (not shown) to allow the user to insert a payable amount of a cash on delivery order into the electronic device 200 (for example, to insert coins or banknotes). The electronic device 200 will notify the order server 250 of a paid amount by the user. After the user completes the payment, the order server 250 will determine that the cash on delivery order has been successfully paid for, notify the electronic device 200 to display a user interface illustrated in FIG. 8C on the touch screen 210 to display a change amount and a locker compartment number for pickup and to print a receipt, and notify the smart locker 100 to open a locker door 114 of a locker compartment 112 corresponding to the cash on delivery order.

FIGS. 9A-9D are schematic diagrams of user interfaces for a non-payment on delivery order during pickup by using a smart locker system according to an embodiment of the present invention. Please refer to FIG. 1 and FIGS. 9A-9D at the same time.

In an embodiment, when the user goes to the smart locker system 10 for the pickup process of a non-cash on delivery order, the user may click on the touch screen 210 of the electronic device 200 to select non-cash on delivery order pickup. At this time, the electronic device 200 will display a user interface illustrated in FIG. 9A on the touch screen 210, allowing the user to enter the consignee's phone number. After the consignee's phone number has been entered, the electronic device 200 sends the consignee's phone number to the order server 250 to verify the order information, and the order server 250 sends back a verification result to the electronic device 200. If the verification is successful, the order server 250 will send back the order information related to the consignee's phone number to the electronic device 200, and the electronic device 200 will display a user interface illustrated in FIG. 9B on the touch screen 210 to allow the user to enter a pickup verification code. For example, when an article corresponding to the order of the user has been shelved onto the smart locker system 10, the smart locker system 10 will notify the order server 250 to send a short message containing the pickup verification code to the consignee's phone number filled in the order of the user. Therefore, the user can fill in a user interface illustrated in FIG. 9B with the received pickup verification code.

After the pickup verification code has been entered, the electronic device 200 sends the pickup verification code to the order server 250 for verification. When the verification is successful, the order server 250 notifies the electronic device 200 to display a user interface illustrated in FIG. 9C on the touch screen 210 to display parcel numbers and quantities of all non-cash on delivery orders corresponding to the consignee's phone number. After the user confirms the completion of the pickup of the order, the electronic device 200 will display a user interface illustrated in FIG. 9D on the touch screen 210 to display a locker compartment number for pickup, and print a receipt. The order server 250 will notify the smart locker 100 to open a locker door 114 of a locker compartment 112 corresponding to the non-cash on delivery order.

FIGS. 10A-10D are schematic diagrams of user interfaces for mixed orders during pickup by using a smart locker system according to an embodiment of the present invention. Please refer to FIG. 1 and FIGS. 10A-10D at the same time.

In an embodiment, when the user goes to the smart locker system 10 to perform the pickup process of mixed orders (including a cash on delivery order and a non-cash on delivery order), the user may click on the touch screen 210 of the electronic device 200 to select pickup for mixed orders. At this time, the electronic device 200 will display a user interface illustrated in FIG. 10A on the touch screen 210, allowing the user to enter the consignee's phone number. After the consignee's phone number has been entered, the electronic device 200 sends the consignee's phone number to the order server 250 to verify the order information, and the order server 250 sends back a verification result to the electronic device 200. If the verification is successful, the order server 250 will send back the order information related to the consignee's phone number to the electronic device 200, and the electronic device 200 will display a user interface illustrated in FIG. 10B on the touch screen 210 to allow the user to enter a pickup verification code. For example, when articles corresponding to the orders of the user have been shelved onto the smart locker system 10, the smart locker system 10 will notify the order server 250 to send a short message containing the pickup verification code to the consignee's phone number filled in the orders of the user. The user can fill in a user interface illustrated in FIG. 10B with the received pickup verification code. Since this embodiment involves pickup for mixed orders, it is still necessary to first verify whether the pickup verification code entered by the user is correct.

After the pickup verification code has been entered, the electronic device 200 sends the consignee's phone number to the order server 250 to verify the order information, and the order server 250 sends back a verification result to the electronic device 200. If the verification is successful, the order server 250 will send back the order information related to the consignee's phone number to the electronic device 200, and the electronic device 200 will display a user interface illustrated in FIG. 10C on the touch screen 210 to display parcel numbers and corresponding payable amounts of all cash on delivery orders corresponding to the consignee's phone number. The electronic device 200 will notify the order server 250 of a paid amount by the user. After the user completes the payment, the order server 250 will determine that the COD order has been successfully paid for, and notify the electronic device 200 to display a user interface illustrated in FIG. 10D on the touch screen 210 to display a change amount and locker compartment numbers for pickup (including cash on delivery orders and non-cash on delivery orders), and print a receipt. The order server 250 notifies the smart locker 100 to open locker doors 114 of locker compartments 112 corresponding to the COD order and the non-COD order.

Figure 11A:
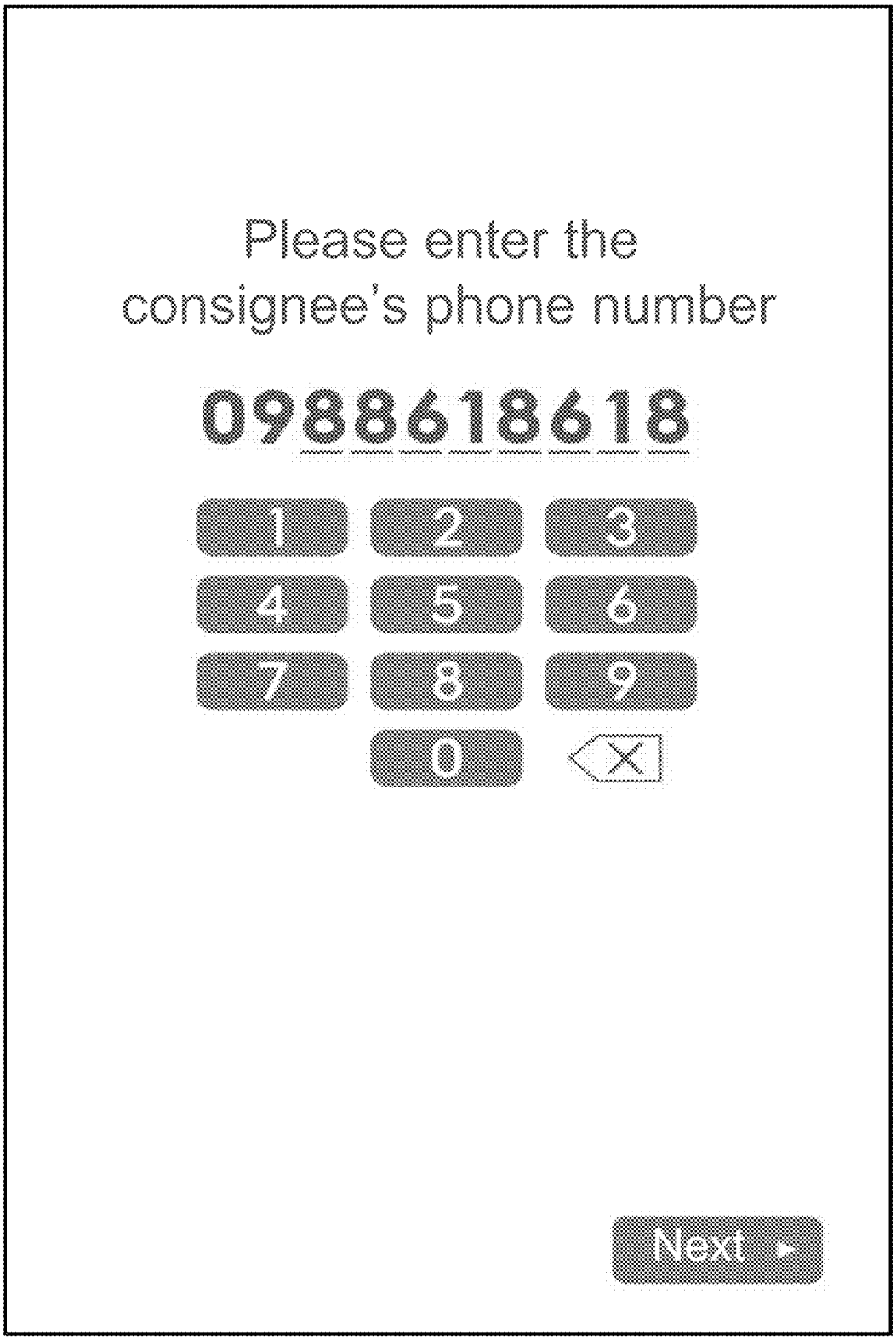
FIGS. 11A-11B are schematic diagrams of user interfaces for reopening a locker door by using a smart locker system according to an embodiment of the present invention.
Figure 11B:
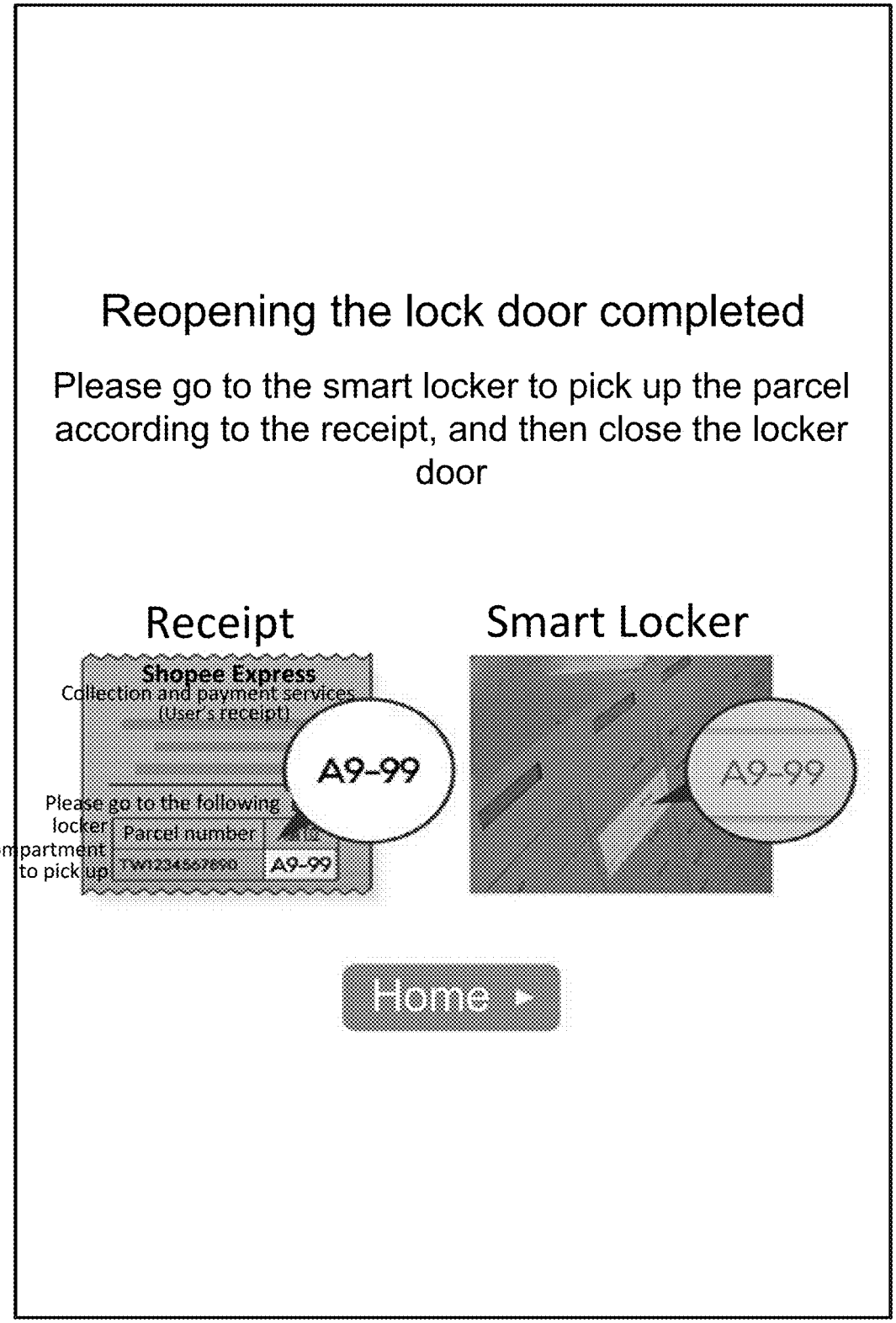

FIGS. 11A-11B are schematic diagrams of user interfaces for reopening a locker door by using a smart locker system according to an embodiment of the present invention. Please refer to FIG. 1 and FIGS. 11A-11B at the same time.

In some embodiments, the user can obtain the pickup locker compartment number for the order through the processes illustrated in FIG. 8-10. However, due to certain factors, the user may not be able to fetch out the order object from the pickup locker compartment corresponding to the pickup locker compartment number within predetermined time. In this case, the locker door corresponding to the pickup locker compartment number will be automatically locked. In addition, before the user has fetched out the order object from the pickup locker compartment, the locker door corresponding to the pickup locker compartment may be mistakenly closed by the user or other person. In this case, the user may operate the electronic device 200 to select a process of reopening the locker door, and the electronic device 200 will display a user interface illustrated in FIG. 11A on the touch screen 210 to allow the user to enter the consignee's phone number. Since the user has verified the pickup verification code and/or completed the payment of the payable amount for the cash on delivery order in the previous process, after the user has entered the consignee's phone number, the electronic device 200 will display a user interface illustrated in FIG. 11B on the touch screen 210 to indicate the completion of the reopening of the locker door and open the locker door 114 of the relevant locker compartment 112 from which the user did not fetch out the object in the previous process.

Figure 12:
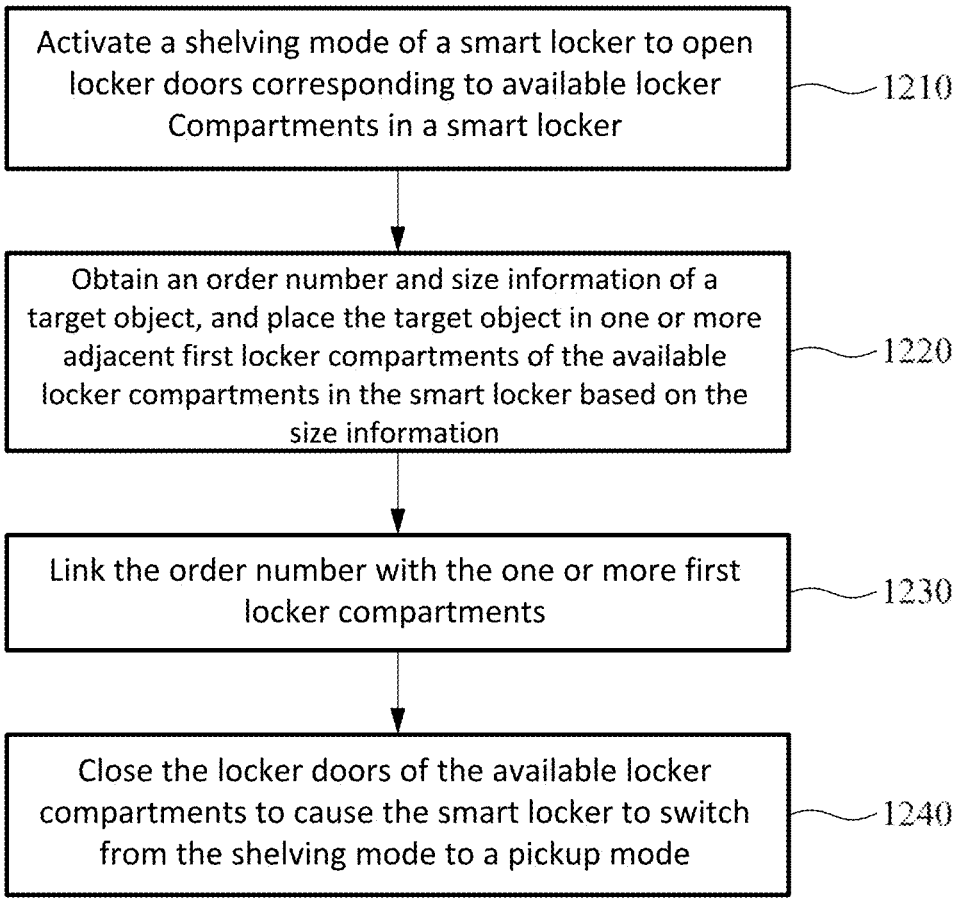
FIG. 12 illustrates a method for storing an object in a smart locker according to an embodiment of the present invention.

FIG. 12 illustrates a flowchart of a method for storing an object in a smart locker according to an embodiment of the present invention. Please refer to FIG. 1 and FIG. 12 at the same time.

In step S1210, a shelving mode of a smart locker 110 is activated to open locker doors of available locker compartments in the smart locker 110. For example, when parcels are delivered to a logistics center after being sent by users, the logistics center may use a detection instrument to scan QR bar codes (not shown) on the parcels to obtain corresponding order numbers, measure the size information of each parcel, and link the measured size information to the corresponding order numbers. Next, when various parcels are delivered to a pickup store, a tallyman in the pickup store will assist in shelving the parcels with various sizes delivered by the logistics center onto the smart locker 100.

At this time, the tallyman may connect an electronic device (such as smartphone, tablet computer or functional handheld electronic device etc.) to an order server 250 of the smart locker system 10 and/or the smart locker 100, and activate a shelving mode of the smart locker 100 (for example, a default mode is a pickup mode). For example, upon activation of the shelving mode of the smart locker 100, a control unit 130 will control door lock devices 116 corresponding to available locker compartments 112 in a cabinet 110 to open corresponding locker doors 114. The available locker compartments 112 may represent locker compartments 112 in which no objects are placed.

In step S1220, an order number and size information of a target object are obtained, and the target object is placed in one or more first locker compartments of the available locker compartments in the smart locker based on the size information. After locker doors corresponding to all available locker compartments 112 are opened, the tallyman may scan a QR bar code of the target object to be shelved to obtain the size information of the parcel from the electronic device. Therefore, it can quickly determine which adjacent available locker compartments 112 the target object can be placed in, e.g., the one or more first locker compartments. It should note that if the size of the target object is larger than the space of a single locker compartment 112, the tallyman may draw out one or more shelf boards in the middle of adjacent first locker compartments to obtain a larger storage space (such as 2-in-1 or 3-in-1 storage space etc.) to adapt to the size of the target object.

In step S1230, bar codes of the one or more first locker compartments may be scanned to link the order number with the bar codes of the one or more first locker compartments. For example, there is a corresponding bar code within each locker compartment 112. After the tallyman has scanned the bar codes of the one or more first locker compartments and a bar code on the target object by using the electronic device, a backend logistics system (such as order server 250) may link the one or more first locker compartments with the order number of the target object to obtain a shelving result corresponding to the order number.

In step S1240, the locker doors corresponding to the available locker compartments are closed to cause the smart locker to switch from the shelving mode to a pickup mode. For example, after the target object has been placed in the storage space of the one or more first locker compartments and the order number of the target object has been linked to the one or more first locker compartments, the tallyman may close the locker doors 114 corresponding to the one or more first locker compartments and continue the shelving process of other target objects or cause the smart locker 100 to switch from the shelving mode to the pickup mode (i.e., default mode). After the smart locker 100 returns to the pickup mode, the user may use the electronic device 200 to perform operations such as check-in, payment, entering of pickup verification code, and opening of locker door for pickup according to the process in the embodiment above.

Figure 13:
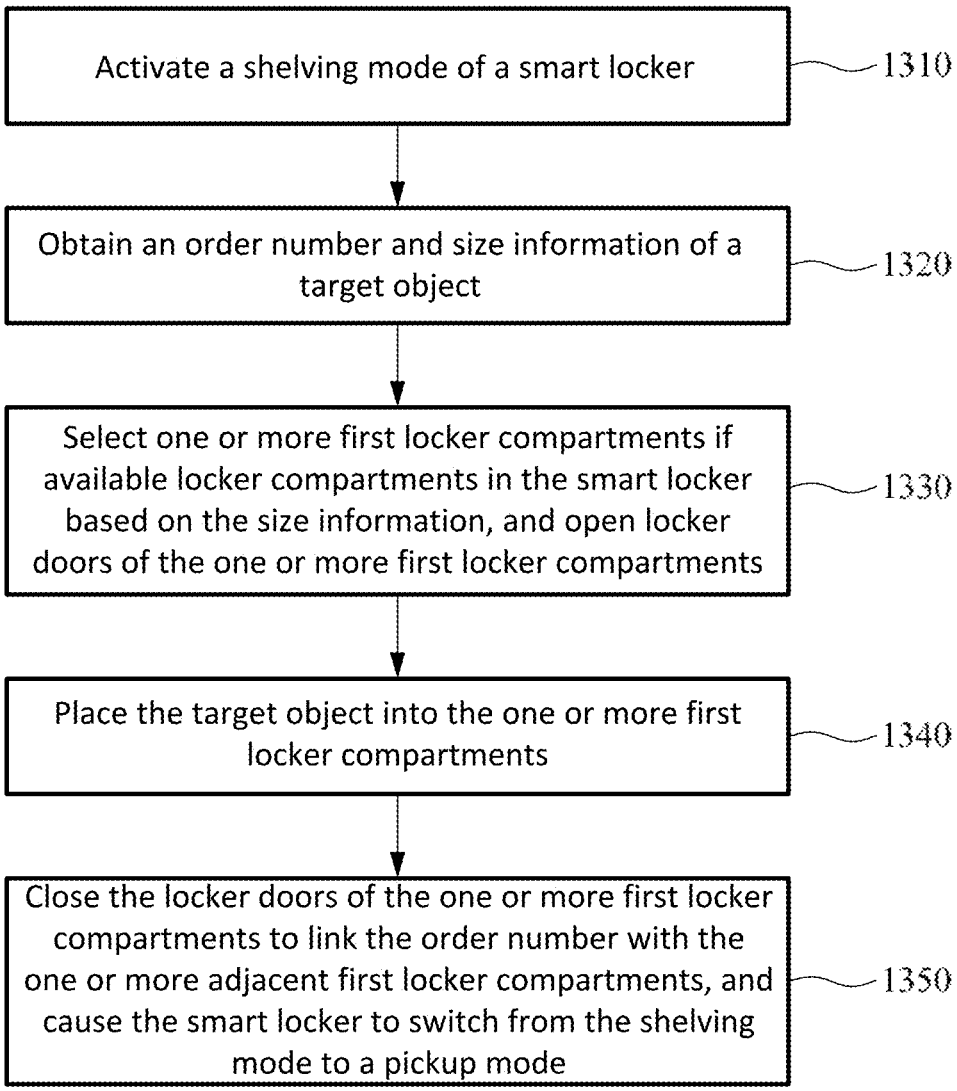
FIG. 13 illustrates a method for storing an object in a smart locker according to another embodiment of the present invention.

FIG. 13 illustrates a method for storing an object in a smart locker according to another embodiment of the present invention. Please refer to FIG. 1 and FIG. 13 at the same time.

In step S1310, a shelving mode of a smart locker is activated. For example, similar to the embodiment illustrated in FIG. 12, a tallyman may connect an electronic device (such as smartphone, tablet computer or functional handheld electronic device etc.) to an order server 250 of a smart locker system 10 and the smart locker 100, and activate a shelving mode of the smart locker 100 (for example, a default mode is a pickup mode). However, unlike the embodiment illustrated in FIG. 12, in the embodiment illustrated in FIG. 13, when the smart locker 100 enters the shelving mode, the smart locker 100 does not open locker doors of all available locker compartments.

In step S1320, an order number and size information of a target object are obtained. For example, the electronic device used by the tallyman has been already connected to an order server 250 of the smart locker system 10 and/or the smart locker 100. Therefore, the electronic device can be used to first scan a QR bar code on the target object to be shelved to obtain the order number and size information of the target object from the electronic device.

In step S1330, one or more first locker compartments of available locker compartments in the smart locker are selected based on the size information, and locker doors of the one or more first locker compartments are opened. For example, a control unit 130 of the smart locker 100 will synchronously receive the size information of the target object, recommend one or more first locker compartments (such as vertically adjacent available locker compartments) suitable for the size information of the target object from the available locker compartments of the smart locker 100 based on a predetermined locker compartment recommendation algorithm, and open locker doors corresponding to the one or more first locker compartments. It should note that if the size of the target object is larger than the space of a single locker compartment 112, the tallyman may draw out one or more shelf boards in the middle of the one or more adjacent first locker compartments to obtain a larger storage space (such as 2-in-1 or 3-in-1 storage space etc.) to adapt to the size of the target object. In other embodiments, after the order number and size information of the target object are obtained, the control unit 130 can determine whether the consignee of the target object has one or more used locker compartments in the smart locker 100. If the consignee has one or more used locker compartments in the smart locker 100, the control unit 130 further determines whether the one or more used locker compartments have a sufficient volume to accommodate the current target object. If the control unit 130 determines that the one or more used locker compartments have a sufficient volume to accommodate the current target object, the control unit 130 recommends one or more first locker compartments from the one or more locker compartments. Therefore, the tallyman can place objects of the same consignee into the same locker compartment (which may be a single locker compartment or large combined locker compartments). Therefore, according to the above method, the present invention not only can save the used space of the locker compartments of the smart locker, but also can help the same consignee to obtain the objects of the related orders from the same locker compartment, thus improving the user experience.

In step S1340, the target objects are placed into the one or more adjacent first locker compartments. For example, the storage space composed of the one or more first locker compartments selected by the control unit 130 of the smart locker 100 adapts to the size of the target object. Therefore, the tallyman can place the target objects into the storage space composed of the one or more first locker compartments.

In step S1350, the locker doors corresponding to the one or more adjacent first locker compartments are closed to link the order number with the one or more first locker compartments, and the smart locker switches from the shelving mode to a pickup mode. For example, when the tallyman places the target objects into the storage space composed of the one or more first locker compartments, the tallyman can close the locker doors corresponding to the one or more first locker compartments, and the control unit 130 will link the order number of the target objects with the one or more first locker compartments, transmit the link relationship to the order server 250, and cause the smart locker to switch from the shelving mode to the pickup mode.

Although the exemplary embodiments of the present invention are disclosed above, they are not intended to limit the scope of the present invention. Anyone with common knowledge in the technical field may make some changes and modifications without departing from the spirit and scope of the present invention. Therefore, the scope of protection of the present invention shall be as defined in the attached claims.

[Description of Reference Signs]

| | |
|---|---|
| 10 | smart locker system |
| 100 | smart locker |
| 110 | cabinet |
| 112, 112R, 112L, 112A, 112B, 112C | locker compartment |
| 114, 114R, 114L, 114A, 114B, 114C | locker door |
| 116 | door locker device |
| 118 | adjustable foot |
| 119 | castor |
| 120 | communication unit |
| 130 | control unit |
| 140 | power supply module |
| 200 | electronic device |
| 202 | middle partition plate |
| 204 | right side plate |
| 206 | left side plate |
| 208 | back plate |
| 210 | touch screen |
| 250 | order server |

-continued

| [Description of Reference Signs] | |
|---|---|
| 303, 403, 603 | sliding rail |
| 3031, 4031, 6031 | upper half sliding rail |
| 3032, 4032 | lower half sliding rail |
| 6032 | sliding rail |
| 310, 410, 510, 610, 710 | shelf board |
| 311, 312, 411, 412, 611, 612 | limiting component |
| 313, 413 | upper surface |
| 711 | fixing member |
| 712 | front groove |
| 713 | rear groove |
| 722 | front fixed column |
| 723 | rear fixed column |
| 724 | groove |
| S1210-S1240, S1310-S1350 | step |

BRIEF DESCRIPTION OF REFERENCE SIGNS OF REPRESENTATIVE DRAWING

10 smart locker system 100 smart locker
110 cabinet
112 locker compartment
114 locker door
116 door lock device
118 adjustable foot
119 castor
120 communication unit
130 control unit
140 power supply module 200 electronic device
210 touch screen
250 order server

What is claimed:

1. A smart locker, comprising:

a cabinet;

a plurality of locker doors, the plurality of locker doors including at least a first locker door and a second locker door; and a plurality of shelf boards configured to vertically divide a storage space of the cabinet into one or more locker compartments, each of the one or more locker compartments includes a locker door of the plurality of locker doors, wherein:

the one or more locker compartments includes a first locker compartment and a second locker compartment, the first locker compartment being adjacent to the second locker compartment, the first locker door is coupled to the first locker compartment and the second locker door is coupled to the second locker compartment, the plurality of shelf boards includes a first shelf board positioned between the first locker compartment and the second locker compartment to form the first locker compartment and the second locker compartment, the first shelf board including an upper surface, a lower surface, and a first limiting component on the upper surface of the first shelf board that extends away from the upper surface, and when the first locker door is closed, the first locker door limits movement of the first shelf board.

2. The smart locker of claim 1, wherein a first inner surface of the cabinet and a second inner surface opposite to the first inner surface are correspondingly provided with a plurality of dividing components, and the plurality of shelf boards are placed on the plurality of dividing components to vertically divide the storage space of the cabinet into the one or more locker compartments.

3. The smart locker of claim 2, wherein each of the plurality of dividing components is a sliding rail.

4. The smart locker of claim 1, wherein the first shelf board further comprises:

a second limiting component, wherein the first limiting component and the second limiting component are disposed at two ends of a first side of the upper surface of the first shelf board, and the first limiting component and the second limiting component have a first height relative to the upper surface of the first shelf board.

5. The smart locker of claim 4, wherein the first limiting component and the second limiting component are bulges or protrusions.

6. The smart locker of claim 4, wherein the first shelf board further comprises:

a third limiting component and a fourth limiting component disposed at two ends of a second side opposite to a first side of the lower surface of the first shelf board, wherein the third limiting component and the fourth limiting component have a second height relative to the lower surface of the first shelf board, and wherein the first height is greater than the second height.

7. The smart locker of claim 6, wherein:

a first inner surface of the cabinet and a second inner surface opposite to the first inner surface are correspondingly provided with a plurality of dividing components, and the plurality of shelf boards are placed on the plurality of dividing components to vertically divide the storage space of the cabinet into the one or more locker compartments; and when the first shelf board is pushed into the cabinet to be placed on a corresponding dividing component of the plurality of dividing components associated with at least one of the first locker compartment and the second locker compartment, the third limiting component and the fourth limiting component exceeds a tail end of the corresponding dividing component to fix the first shelf board to the corresponding dividing component.

8. The smart locker of claim 3, wherein the sliding rail of each of the plurality of dividing components comprises an upper half sliding rail and a lower half sliding rail, and a height between the upper half sliding rail and the lower half sliding rail allows a shelf board of the plurality of shelf boards to be pushed into the cabinet within a predetermined angle range to be placed on the lower half sliding rail.

9. The smart locker of claim 3, wherein the first shelf board further comprises:

a second limiting component disposed at one end of a first side of a lower surface of the first shelf board, wherein the second limiting component comprises a tenon extending towards an inner side of the cabinet.

10. The smart locker of claim 9, wherein when the first shelf board is completely pushed into the sliding rail of at least one dividing component of the plurality of dividing components, a bottom of the tenon of the second limiting component presses against an upper edge of the at least one dividing component, and wherein, when the first side of the first shelf board is pressed down, the bottom of the tenon of the first second limiting component is located below the at least one dividing component to press against the at least one dividing component to fix the first shelf board.

11. The smart locker of claim 2, wherein the plurality of dividing components disposed in the cabinet comprise front fixed columns and rear fixed columns, a first side of each of the plurality of shelf boards and a second side of each of the plurality of shelf boards opposite to the first side comprise front grooves and rear grooves, the front grooves and the rear grooves are respectively inverted-U-shaped and inverted-L-shaped, and the front fixed columns and the rear fixed columns of the cabinet are respectively snapped into the front grooves and the rear grooves of the plurality of shelf boards, so that the plurality of shelf boards are horizontally placed in the cabinet.

12. The smart locker of claim 11, wherein the first side of each of the plurality of shelf boards is provided with a fixing member beside a corresponding front groove, and when each of the plurality of shelf boards are horizontally placed in the cabinet, the fixing member is snapped into a corresponding groove provided in the cabinet to fix a corresponding shelf board of the plurality of shelf boards.

13. The smart locker of claim 1, further comprising:

a plurality of locker compartments including the one or more locker compartments, wherein the smart locker enters a shelving mode in response to an input signal and the smart locker opens at least the first locker compartment of the plurality of locker compartments based on the input signal.

14. The smart locker of claim 13, wherein the input signal is size information of a target object, and the one or more locker compartments are vertically adjacent available locker compartments.

15. The smart locker of claim 14, further comprising:

an electronic device, the electronic device links order information of the target object with the one or more locker compartments based on to the target object being placed into the one or more locker compartments and the locker door of each of the one or more locker compartments being closed.

* * * * *